US008534568B2

(12) United States Patent
Gautschi et al.

(10) Patent No.: US 8,534,568 B2
(45) Date of Patent: Sep. 17, 2013

(54) SANITARY FITTING WITH A JOYSTICK CONTROLLER

(75) Inventors: Christian Gautschi, Sursee (CH); Daniel Baumann, Schmiedrued (CH)

(73) Assignee: KWC AG, Unterkulm (CH)

( * ) Notice: Subject to any disclaimer, the term of this patent is extended or adjusted under 35 U.S.C. 154(b) by 884 days.

(21) Appl. No.: 12/707,166

(22) Filed: Feb. 17, 2010

(65) Prior Publication Data

US 2010/0206956 A1 Aug. 19, 2010

(30) Foreign Application Priority Data

Feb. 17, 2009 (EP) ..... 09002169

(51) Int. Cl.
*G05D 23/13* (2006.01)

(52) U.S. Cl.
USPC ..... 236/12.15; 236/12.1; 236/12.11; 236/12.12

(58) Field of Classification Search
USPC ..... 236/12.1, 12.11, 12.12, 12.15; 137/614
See application file for complete search history.

(56) References Cited

U.S. PATENT DOCUMENTS

| | | | |
|---|---|---|---|
| 3,653,407 | A | 4/1972 | Katva |
| 4,479,038 | A | 10/1984 | Marhold et al. |
| 5,151,563 | A | 9/1992 | Tanaka |
| 5,988,593 | A | 11/1999 | Rice |
| 6,256,986 | B1 | 7/2001 | Langen et al. |
| 6,295,810 | B1 | 10/2001 | Langen et al. |
| 6,352,179 | B1 | 3/2002 | Andersen et al. |
| 6,367,707 | B1 | 4/2002 | Kang |
| 6,755,195 | B1 | 6/2004 | Lemke et al. |
| 7,150,293 | B2 | 12/2006 | Jonte |
| 7,242,390 | B2 | 7/2007 | Bader et al. |
| 7,275,370 | B2 | 10/2007 | Hesse et al. |
| 7,537,023 | B2 | 5/2009 | Marty et al. |
| 2002/0149565 | A1 | 10/2002 | Sako |
| 2006/0130907 | A1 | 6/2006 | Marty et al. |
| 2006/0186215 | A1 | 8/2006 | Logan |

(Continued)

FOREIGN PATENT DOCUMENTS

| | | | |
|---|---|---|---|
| DE | 32 31 214 | A1 | 2/1984 |
| DE | 298 07 233 | U1 | 8/1998 |

(Continued)

OTHER PUBLICATIONS

European Search Report with English-language Translation mailed Nov. 30, 2009 for European Patent Application No. 09002168.4.

(Continued)

*Primary Examiner* — Marc Norman
*Assistant Examiner* — Jonathan Bradford
(74) *Attorney, Agent, or Firm* — Oliff & Berridge, PLC

(57) ABSTRACT

A sanitary fitting includes a cold water connection; a hot water connection; a mixed water outlet; a valve device for setting a mixed water temperature and a mixed water through-flow rate, wherein the valve device is connected to the cold water connection and the hot water connection at one end and is connected to the mixed water outlet at the other end; an electrical controller for actuating a valve; and a control signal transmitter for generating an input signal to the controller, wherein the valve is an integral constituent part of the valve device, and the controller actuates the valve device as a function of the input signal of the control signal transmitter such that a mixed water temperature and a mixed water through-flow rate are set.

112 Claims, 5 Drawing Sheets

(56) References Cited

U.S. PATENT DOCUMENTS

| | | | | |
|---|---|---|---|---|
| 2006/0192161 | A1 | 8/2006 | Kuna et al. | |
| 2007/0151613 | A1 | 7/2007 | Hahn et al. | |
| 2007/0246550 | A1 * | 10/2007 | Rodenbeck et al. | 236/12.11 |

FOREIGN PATENT DOCUMENTS

| | | | |
|---|---|---|---|
| DE | 103 04 595 | B3 | 10/2004 |
| DE | 20 2004 006 110 | U1 | 9/2005 |
| DE | 10 2004 051 525 | A1 | 4/2006 |
| DE | 10 2006 017 598 | A1 | 10/2006 |
| DE | 10 2006 028 227 | A1 | 12/2006 |
| DE | 10 2006 028 228 | A1 | 12/2006 |
| EP | 0 400 633 | A2 | 5/1990 |
| EP | 2 023 359 | A1 | 2/2009 |
| GB | 2 040 465 | A | 8/1980 |
| KR | 101 995 000 4212 | B1 | 4/1995 |
| WO | WO 2006/091170 | A1 | 8/2006 |
| WO | WO 2006/098795 | A2 | 9/2006 |
| WO | WO 2007/129504 | A1 | 11/2007 |
| WO | WO 2009/019731 | A2 | 2/2009 |

OTHER PUBLICATIONS

European Search Report with English-language Translation mailed Jul. 24, 2009 for European Patent Application No. 09002169.2.

* cited by examiner

SANITARY FITTING WITH A JOYSTICK CONTROLLER

CROSS-REFERENCE TO RELATED APPLICATION

This application claims priority from European Patent Application No. EP 09 002 169.2, filed Feb. 17, 2009, the entire disclosure of which is incorporated herein by reference thereto.

BACKGROUND

The present invention relates to a sanitary fitting.

Sanitary fittings for dispensing water, in particular for dispensing mixed water which is made up of a mixture of cold water and hot water, are generally known. In order to be able to set the water being dispensed to a specific mixed water throughflow rate and a specific mixed water temperature, it is known to provide sanitary fittings with valve devices. These valve devices, or valves which are integrated in the valve devices, typically have a cold water connection and a hot water connection at one end and a mixed water outlet at the other end. Valve devices of this type may have a hydraulic single-lever mixer, as disclosed in WO 2006/098795, for example.

In addition, valves which can be actuated by means of an electrical controller in order to open or to close said valves are available. In this case, a control signal transmitter for generating an input signal to the controller can be used, with the controller correspondingly actuating the valves on the basis of the input signal.

The sanitary fitting which is disclosed in WO 2006/098795 has a hydraulic single-lever mixer as the valve device, in order to manually set the mixed water throughflow rate and the mixed water temperature. In addition, an electrically actuable valve is integrated, it being possible to operate said valve in two different modes. In a manual mode, the valve is open and the mixed water throughflow rate and the mixed water temperature are controlled solely by the manually operable single-lever mixer. In a second mode, the mixed water throughflow rate and the mixed water temperature are preset by the manually operable single-lever mixer, and the electrically actuable valve can be either completely open or completely closed. In this case, the controller receives an input signal from a touch sensor or ambient sensor when an object (for example a hand) is in the vicinity of the sensor. This input signal causes the controller to transmit an "on" or an "off" flip-flop signal to the valve, this signal in turn causing the valve to be completely closed or completely opened and accordingly causing the water throughflow to be opened or closed.

SUMMARY

One object of the present invention is to provide a sanitary fitting having a control signal transmitter, it being possible to set both the mixed water temperature and the water throughflow rate by means of the control signal transmitter, and the control signal transmitter being only electrically connected to the valve device by means of an electrical controller. This permits fine and differentiated control of the mixed water temperature and mixed water throughflow rate with various possible additional functions which can be implemented in the electronic controller.

This object is achieved by a sanitary fitting having a cold water connection, a hot water connection and a mixed water outlet. In addition, said sanitary fitting is equipped with a valve device. Said valve device is connected to the hot water connection and the cold water connection at one end, and to the mixed water outlet at the other end. The valve device can combine the cold water and the hot water to produce mixed water which is then dispensed through the mixed water outlet. In this case, different mixed water temperatures and mixed water throughflow rates can be set by different ratios of proportions of hot water and cold water in the mixed water.

The sanitary fitting also contains an electrical controller for actuating a valve, it being possible for the control signal transmitter to generate an input signal to the controller. In this case, in the present invention, the valve is an integral constituent part of the valve device, and the controller actuates the valve device as a function of the input signal of the control signal transmitter. As a result, the mixed water temperature and the mixed water throughflow rate can be set. This construction permits a very space-saving design of the control signal transmitter since it is not in direct contact with the water connections and a valve does not need to be integrated. Both the mixed water temperature and the water throughflow rate can be set by the user solely using the control signal transmitter. Since the control signal transmitter is connected to the valve device by means of an electrical controller, it is possible to program the controller such that an outflow of mixed water which is finely graded and differentiated in terms of temperature and quantity is possible. In addition, various possible additional functions which can be triggered by corresponding operation of the control signal transmitter can be implemented in the controller.

In a preferred embodiment, the control signal transmitter is an electrical joystick with an operating lever mounted in a base element. The mounting and technical construction of the joystick are described in detail in the patent application entitled "Sanitary fitting with a joint" (representative reference A18634EP) which was filed on the same date by the same applicant, and reference is expressly made to the disclosure of said document.

In a preferred embodiment, the operating lever has an operating lever end region which can be deflected out of its neutral, preferably central, inoperative position in at least two planes which are at least approximately at right angles to one another. In addition, the base element is equipped with at least one sensor in order to determine the position of the operating lever relative to its neutral inoperative position and to convert said position into the electrical input signal. To this end, the base element is preferably equipped with a sensor which interacts with a sensor end, which is averted from the operating lever end region, of the operating lever.

In a particularly preferred embodiment, the operating lever is in this case equipped with a permanent magnet at its sensor end, said permanent magnet interacting with Hall sensors which are firmly mounted with respect to the base element of the joystick. This design permits a long service life of the operating lever, and respectively of the joystick arrangement, since the construction has only a few parts which move and rub against one another, and therefore wear is minimized. In addition, the use of Hall sensors and a permanent magnet permits a very space-saving design.

In a further preferred embodiment, the input signal can contain a positive water quantity signal, a negative water quantity signal, a positive temperature signal or a negative temperature signal. In this case, the controller transmits a signal for increasing the mixed water throughflow rate to the valve device on the basis of the reception of the positive water quantity signal. Analogously, the controller transmits a signal for reducing the mixed water throughflow rate to the valve device on the basis of the reception of the negative water quantity signal, transmits a signal for increasing the mixed water temperature on the basis of the reception of the positive temperature signal, and transmits a signal for reducing the mixed water temperature on the basis of the reception of the negative temperature signal. This construction permits extremely simple operator control of the sanitary fitting which is highly intuitive for a user. By virtue of this type of signal transmission and control of the valve device, any desired mixed water throughflow rates at any desired mixed water temperature can be set in a simple manner.

In a further preferred embodiment, a temperature memory for storing a mixed water temperature value which can be set by means of the control signal transmitter, a mixed water throughflow memory for storing a current mixed water throughflow rate and a timer for storing a time value are integrated in the controller. These memories make it possible for the logic system of the controller to be upgraded by means of various additional functions in respect of the above-described simpler variants, it being possible for these additional functions to be triggered by a specific manner of operation of the control signal transmitter, as described below.

In this preferred embodiment, the mixed water throughflow memory and the temperature memory permit a controller which allows proportional regulation by means of pulsed input signals from the control signal transmitter.

The timer serves to compare the duration of the input signal and the time sequence of the input signals with the prespecified values implemented in the controller. As a result it is possible, for the first time, to distinguish between a relatively long input signal and a pulsed input signal or to evaluate the time sequence of pulsed input signals.

In this preferred embodiment, a distinction can, in principle, be drawn between two different manners of operation of the control signal transmitter both with regard to the regulation of the mixed water temperature and of the mixed water flow rate:

A first manner of operation is pulsed operation, in which the control signal transmitter is deflected out of its neutral inoperative position only for a brief time, for example at most 0.3 seconds. In a second manner of operation, the control signal transmitter is deflected constantly out of its neutral inoperative position for a relatively long time, that is to say longer than 0.3 seconds for example. In this case, this time value in each case corresponds to the values stored in the timer for a positive temperature time value, a negative temperature time value, a positive water quantity time value and a negative water quantity time value.

The controller can preferably actuate the valve device in such a way that the mixed water throughflow rate is continuously increased at an at least approximately constant mixed water temperature in line with that stored in the temperature memory, when a constant positive water quantity signal is received. This allows the mixed water quantity to be increased slowly and steadily in a controlled manner.

The controller can preferably actuate the valve device in such a way that the mixed water throughflow rate is continuously reduced at an at least approximately constant mixed water temperature value in line with that stored in the temperature memory, when a constant negative water quantity signal is received. This allows the mixed water quantity to be reduced slowly and steadily in a controlled manner.

The controller can preferably actuate the valve device in such a way that the mixed water throughflow rate is suddenly increased to this lower mixed water throughflow limit value at an at least approximately constant mixed water temperature when a pulsed positive water quantity signal is received and if the current mixed water throughflow rate in line with the value stored in the mixed water throughflow memory is lower than a lower mixed water throughflow limit value, preferably 30%.

The controller can preferably actuate the valve device in such a way that the mixed water throughflow rate is suddenly increased to the upper mixed water throughflow value at an at least approximately constant mixed water temperature when a pulsed positive water quantity signal is received and if the current mixed water throughflow is at the lower mixed water throughflow limit value or between the lower mixed water throughflow limit value and an upper mixed water throughflow limit value of preferably 80%. As a result, the mixed water throughflow can be suddenly increased to a value which corresponds to the upper mixed water throughflow limit value.

Combination of the procedures described above allows the mixed water throughflow to be increased suddenly from, for example, a minimum of 0% to the upper mixed water throughflow limit value by double pulsed tapping in close succession.

The controller can preferably actuate the valve device in such a way that the valve is closed without delay such that the mixed water throughflow rate reaches the value zero when a pulsed negative water quantity signal is received. This can quickly and suddenly stop the outflow of mixed water.

The controller can preferably actuate the valve device in such a way that the mixed water temperature value in the temperature memory is continuously increased until the end of the positive temperature signal or until the mixed water temperature value has reached an upper temperature limit value when a constant positive temperature signal is received and if the current mixed water throughflow is zero. This allows the mixed water temperature to be selected to increase slowly and steadily.

The controller can preferably actuate the valve device in such a way that the mixed water temperature value in the temperature memory is continuously increased until the end of the positive temperature signal or until the mixed water temperature value has reached an upper temperature limit value when a constant positive temperature signal is received and if the current mixed water throughflow is greater than zero. At the same time, the mixed water temperature of the mixed water being dispensed is continuously adapted, at an at least approximately constant mixed water throughflow rate, in accordance with the mixed water temperature value. This allows the mixed water temperature of the mixed water currently being dispensed to be increased slowly and steadily in a controlled manner.

The controller can preferably actuate the valve device in such a way that the mixed water temperature value in the temperature memory is set to the upper temperature limit value when the pulsed positive temperature signal is received and if the current mixed water throughflow rate is zero. This allows the preset mixed water temperature to be suddenly increased.

The controller can preferably actuate the valve device in such a way that the mixed water temperature value in the temperature memory is set to an upper temperature limit value when the pulsed positive temperature signal is received and if the current mixed water throughflow rate is greater than zero, and at the same time the mixed water temperature is adapted in accordance with the mixed water temperature value at an at least approximately constant mixed water throughflow rate. This allows the mixed water temperature of the mixed water currently being dispensed to be suddenly increased.

The controller can preferably actuate the valve device in such a way that the mixed water temperature value in the temperature memory is continuously reduced until the end of the negative temperature signal or until the mixed water temperature value has reached a lower temperature limit value when the constant negative temperature time value is received and if the current mixed water throughflow rate is zero. This allows the preset mixed water temperature to be selected to reduce slowly and steadily in a controlled manner.

The controller can preferably actuate the valve device in such a way that the mixed water temperature value in the temperature memory is continuously decreased until the end of the negative temperature signal or until the mixed water temperature value has reached a lower temperature limit value when the constant negative temperature signal is received and if the current mixed water throughflow rate is greater than zero. At the same time, the mixed water temperature of the mixed water being dispensed is correspondingly continuously adapted at an approximately constant mixed water throughflow rate. This allows the mixed water temperature of the mixed water currently being dispensed to be reduced slowly and steadily in a controlled manner.

The controller can preferably actuate the valve device in such a way that the mixed water temperature value in the temperature memory is set to a lower temperature limit value when the pulsed negative temperature signal is received and if the current mixed water throughflow rate is zero. This allows the preset mixed water temperature to be suddenly reduced.

The controller can preferably actuate the valve device in such a way that the mixed water temperature value is set to an upper temperature limit value when the pulsed negative temperature signal is received and if the current mixed water throughflow rate is greater than zero. At the same time the mixed water temperature is adapted in line with the mixed water temperature value at an at least approximately constant mixed water throughflow rate. This allows the mixed water temperature of mixed water currently being dispensed to be suddenly reduced.

The mixed water temperature is preferably increased or reduced, when a constant, relatively long, positive temperature input signal or a constant, relatively long, negative temperature input signal is received, continuously along a predefined first temperature control characteristic curve, preferably a linear temperature control characteristic curve with a predefined gradient (with a positive gradient in the case of the increase, preferably with an equal but negative gradient in the case of the reduction). Accordingly, the mixed water throughflow rate is increased or reduced, when a constant, relatively long, positive water quantity input signal or a constant, relatively long, negative water quantity input signal is received, continuously along a predefined first water quantity regulation curve, preferably a linear water quantity regulation curve with a predefined gradient (with a positive gradient in the case of the increase, and preferably with an equal but negative gradient in the case of the reduction). However, other curve profiles which rise or fall continuously are likewise feasible for the temperature control characteristic curve or the water quantity regulation curve.

In contrast to reception of a continuous positive temperature input signal or negative temperature input signal, the mixed water temperature is increased or reduced suddenly, in practice preferably along a second linear temperature control characteristic curve with a much steeper gradient compared to the gradient of the first temperature control characteristic curve, when a short, pulsed positive temperature input signal or negative temperature input signal is received. Accordingly, in contrast to the reception of a continuous positive water quantity input signal or negative water quantity input signal, the mixed water quantity increases or reduces suddenly, in practice preferably along a second linear water quantity regulation curve with a much steeper gradient compared to the gradient of the first water quantity regulation curve, when a short, pulsed positive water quantity input signal or negative water quantity input signal is received.

The water throughflow rate can, for example, be changed linearly between 0% and 100% in 0.3 seconds in the case of a pulsed signal, and in 3 seconds in the case of a continuous signal.

The mixed water temperature can, for example, be changed linearly between 0% and 100% in 0.5 seconds in the case of a pulsed signal, and in 2 seconds in the case of a continuous signal.

In a preferred embodiment, the lower temperature limit value corresponds to the temperature of the cold water which arrives at the valve device through the cold water connection. Accordingly, the upper temperature limit value preferably corresponds to the temperature of the hot water which arrives at the valve device through the hot water connection.

In a further preferred embodiment of the present invention, the input signal, positive water quantity signal, is associated with a deflection plane in one deflection direction and the negative water quantity signal is associated with the deflection plane in the corresponding opposite deflection direction. Accordingly, the positive temperature signal is associated with the other deflection plane in one deflection direction and the negative temperature signal is associated with said other deflection plane in the correspondingly further opposite deflection direction. Association of this type is intuitive and therefore allows the user to operate the sanitary fitting in a simple manner.

In a further preferred embodiment, a first valve of the valve device comprises a first proportional valve which is connected to the cold water connection on its intake side and to the mixed water outlet on its outflow side. Accordingly, a second valve of the valve device comprises a second proportional valve which is connected to the hot water connection on its intake side and to the mixed water outlet on its outflow side. In this case, the controller actuates the first proportional valve with a first electrical control signal, and actuates the second proportional valve with a second electrical control signal.

If the mixed water temperature is now to be changed, for example at a constant mixed water throughflow rate, the first and the second proportional valves are actuated in an equal but opposite manner. In the process, the first proportional valve is closed (or opened) by a first percentage value and the second proportional valve is opened (or closed) by a second percentage value, and therefore the mixed water throughflow rate always remains—at least approximately—constant (that is to say the sum of the percentage openings of the first proportional valve and the second proportional valve always have to be kept constant).

If the mixed water throughflow rate is now to be changed, for example at a constant mixed water temperature, the first and the second proportional valves are actuated in such a way that the two valves are either opened by a first and a second opening value (in the case of the increase in the mixed water throughflow rate) or are closed by a first and a second closing value (in the case of a reduction in the mixed water throughflow rate). However, the opening ratio of the first proportional valve to the second proportional valve always has to remain constant in order to keep the mixed water temperature at an—at least approximately—constant temperature value.

In a further preferred embodiment, a light source, preferably a light-emitting diode (LED), is mounted on the sanitary fitting. Said light source is actuated by the electrical controller in such a way that it emits a light in different colors as a function of the selected or stored mixed temperature value. As a result, the user of the sanitary fitting can visually identify the set mixed water temperature in a simple and intuitive manner. Therefore, accidents, for example scalding by hot water which has been set to be too hot, are avoided.

In a particularly preferred embodiment, the light-emitting diode is mounted on the control signal transmitter, and this can suggest to the user a direct visual relationship between the control signal input and the mixed water temperature, and therefore facilitate operator control of the sanitary fitting.

The negative temperature time value, the positive temperature time value, the negative water quantity time value and the positive water quantity time value can have different values. However, in a preferred embodiment, these values are all the same, preferably 0.3 seconds.

BRIEF DESCRIPTION OF THE DRAWINGS

The invention will be explained with reference to an exemplary embodiment which is illustrated in the drawing in which, purely schematically.

DETAILED DESCRIPTION OF EMBODIMENTS

Figure 1:
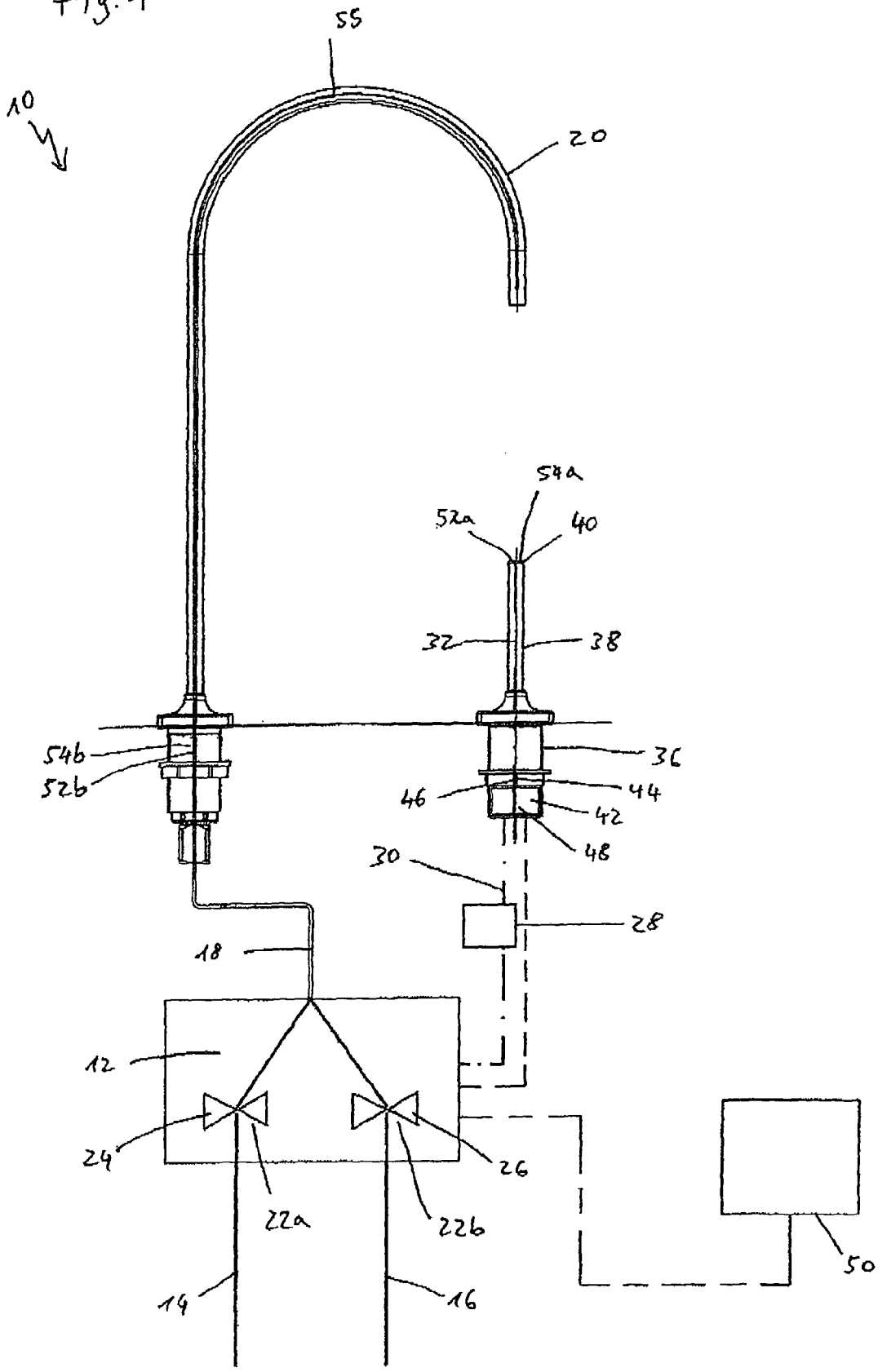
FIG. 1 shows a sanitary fitting having a control signal transmitter in the form of a joystick, an electrical controller which is connected to the joystick and to a valve device which contains a cold water connection and a hot water connection and a mixed water outlet, with the mixed water outlet being connected to a water outlet pipe.

FIG. 1 schematically shows one possible design of a sanitary fitting 10 according to the invention. The sanitary fitting 10 has a valve device 12 which is connected to a cold water connection 14 and a hot water connection 16 at one end and is connected to a mixed water outlet 18 at the other end. In this case, the mixed water outlet 18 is connected to a water outlet pipe 20. The valve device 12 in turn contains at least one valve 22*a*, 22*b* as an integral constituent part, with two proportional valves 24, 26 being integrated in the valve device 12 in a preferred embodiment. In this case, the first proportional valve 24 is connected to the cold water connection 14 at one end and is connected to the mixed water outlet 18 at the other end, and the second proportional valve 26 is connected to the hot water connection 16 at one end and is connected to the mixed water outlet 18 at the other end.

In addition, the sanitary fitting 10 has an electrical controller 28 which actuates the valve device 12 as a function of an input signal 30. The electrical controller 28 receives the input signal 30 from a control signal transmitter 32, preferably from a joystick 34 which contains an operating lever 38 which is mounted in a base element 36. The mounting and technical construction of the joystick 34 and of the discharge with the discharge pipe 20 are described in detail in the patent application entitled "Sanitary fitting with a joint" (representative reference A18634EP) which was filed on the same date by the same applicant.

In a preferred embodiment, the operating lever 38 contains an operating lever end region 40 which can be deflected out of its neutral, central inoperative position in two planes which are at least approximately at right angles to one another. In addition, the base element 36 is equipped with at least one sensor 42 which interacts with a sensor end 44, which is averted from the operating lever end region 40, of the operating lever 38 in order to determine the position of the operating lever 38 relative to its neutral, central inoperative position and to convert said position into the electrical input signal.

In this case, the operating lever 38 is preferably equipped with a permanent magnet 46 at its sensor end 44, said permanent magnet interacting with Hall sensors 48 which are firmly mounted with respect to the base element 36 of the joystick 34.

The mixed water temperature and the mixed water throughflow rate are set by actuating the valve device 12. Both the electrical controller 28 and also the joystick 34 and the valve device 12 are connected to a power supply means 50. In a preferred embodiment, a light source 52*a*, particularly preferably a light-emitting diode 54*a*, is mounted on the operating lever 38 of the joystick 34, said light source indicating the mixed water temperature stored in a temperature memory of the electrical controller 28 by virtue of a corresponding color. In a further embodiment, the or a further light source 52*b* or light-emitting diode 54*b* can be mounted at an end of the water outlet pipe 20 which faces the valve device, in order to illuminate the mixed water being dispensed with a color which corresponds to the mixed water temperature. In order to minimize scatter losses from said light, a light guide 55 can be routed from the light source 52*b* or the light-emitting diode 54*b* to a water outlet end, which is opposite said end of the water outlet pipe 20, of the water outlet pipe 20 within the water outflow pipe 20 in a further embodiment, said light guide guiding the light to the water outlet end of the water outlet pipe 20 and illuminating the mixed water as it emerges from the water outlet pipe 20.

Figure 2:
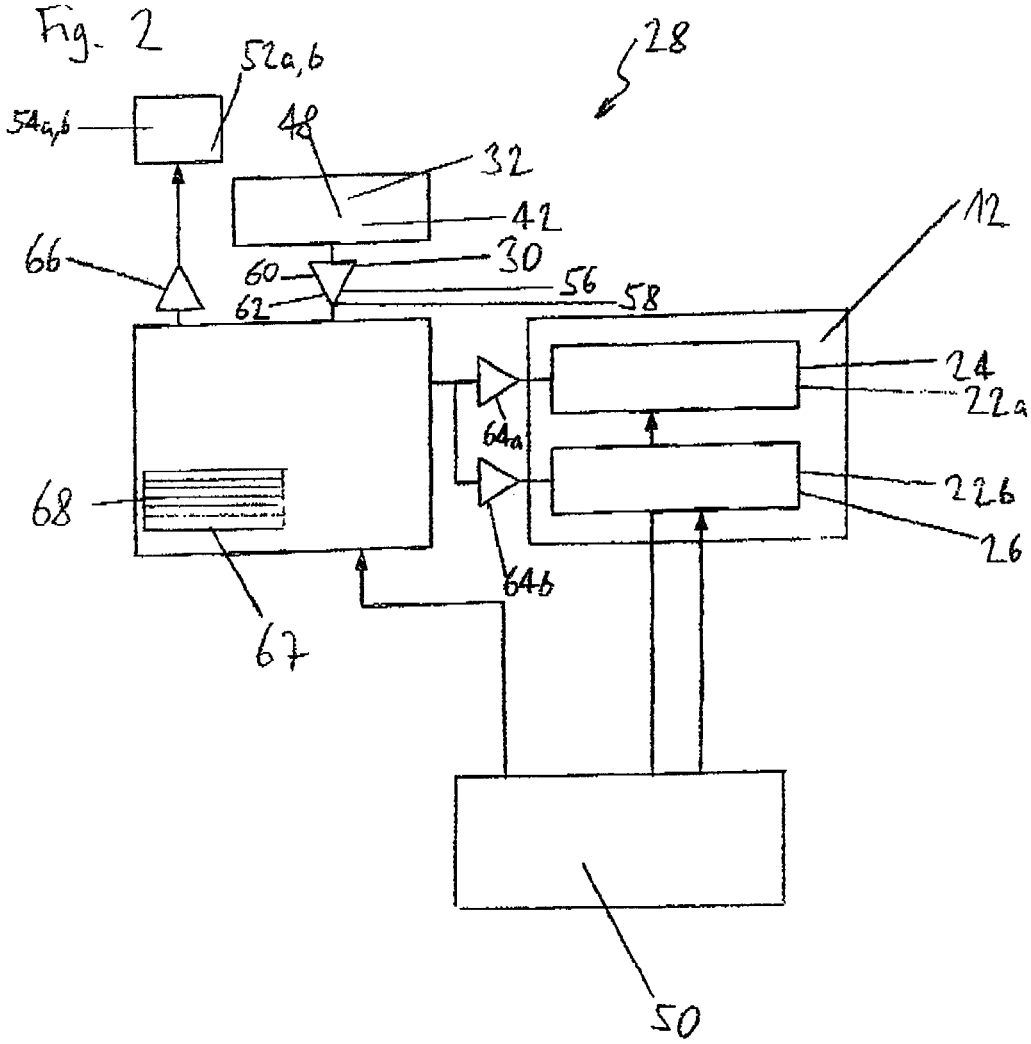
FIG. 2 shows the electrical controller containing a power supply means, with the controller receiving input signals from the control signal transmitter and emitting signals to the valve device and a light source.

FIG. 2 shows a schematic view of a detail of the electrical controller 28 and the components to which the controller 28 is connected. The controller 28 is connected to the power supply means 50. Said controller receives input signals 30 which can comprise, for example, a positive water quantity signal 56, a negative water quantity signal 58, a positive temperature signal 60 or a negative temperature signal 62. These input signals 30 originate from the control signal transmitter 32 or the sensor 42 integrated in said control signal transmitter, for example the Hall sensors 48. The controller 28 can emit a first electrical control signal 64*a* to the first proportional valve 24 or a second electrical control signal 64*b* to the second proportional valve 26 in order to increase or reduce the water throughflow. In addition, the controller 28 can emit a light control signal 66 to the light source 52*a*, 52*b* or the light-emitting diode 54*a*, 54*b* in order to determine the color of the light which is emitted by the light source 52*a*, 52*b* or the light-emitting diode 54*a*, 54*b*.

The controller 28 has a programmable microprocessor. A register 67 with a plurality of register locations 68 is integrated in the controller 28. Various values can be stored in said register, for example a value for the mixed water temperature in a temperature memory register, a value for the mixed water throughflow rate in a mixed water throughflow memory register, or various time values (for example a negative water quantity time value, a positive water quantity time value, a negative temperature time value or a positive temperature time value) in a timer register. These memory modules permit the logic system of the controller 28 or of the microprocessor to be upgraded with various additional functions which can be triggered by a specific manner of operation of the control signal transmitter 32.

Figure 3A:
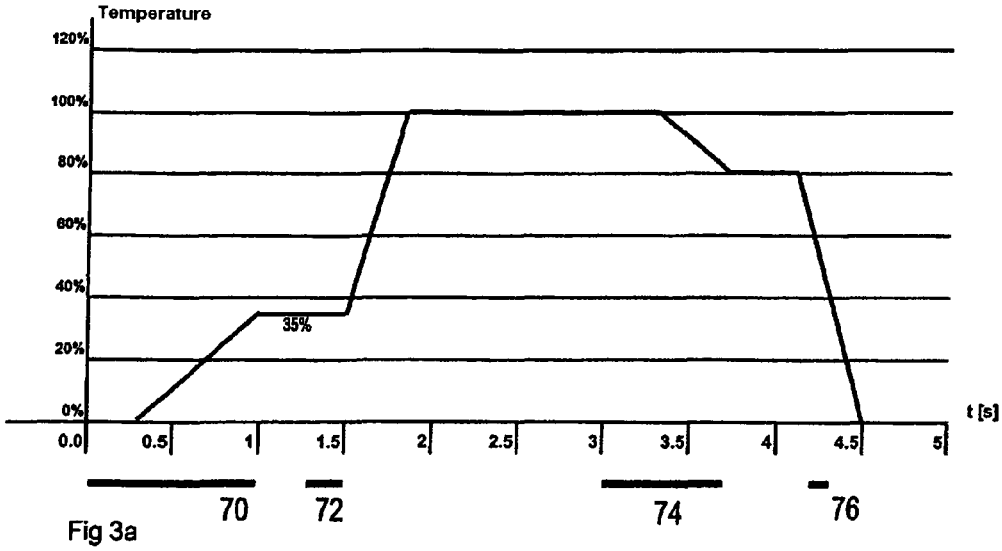
FIG. 3*a* shows a first example of a mixed water temperature profile as a function of various input signals.
Figure 3B:
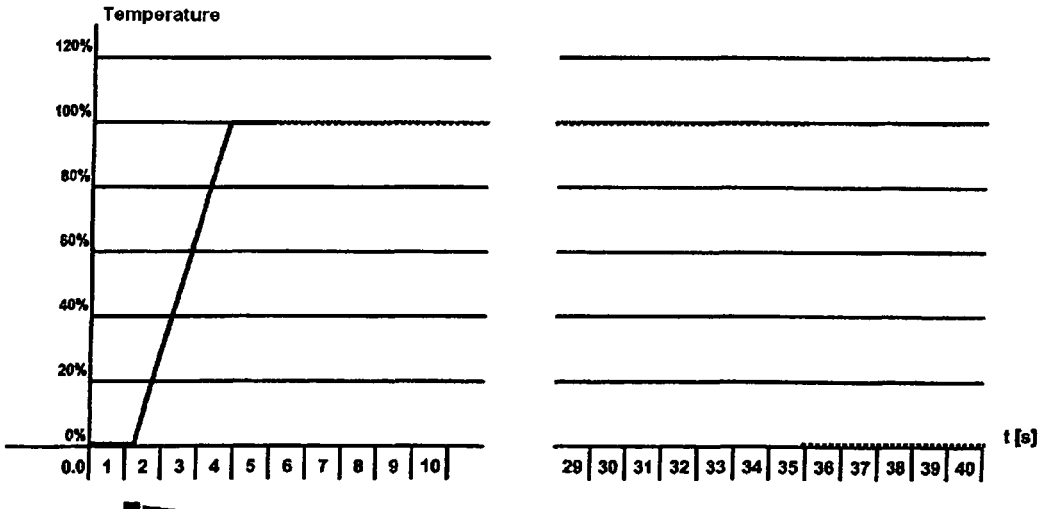
FIG. 3*b* shows a second example of a mixed water temperature profile as a function of various input signals.
Figure 3C:
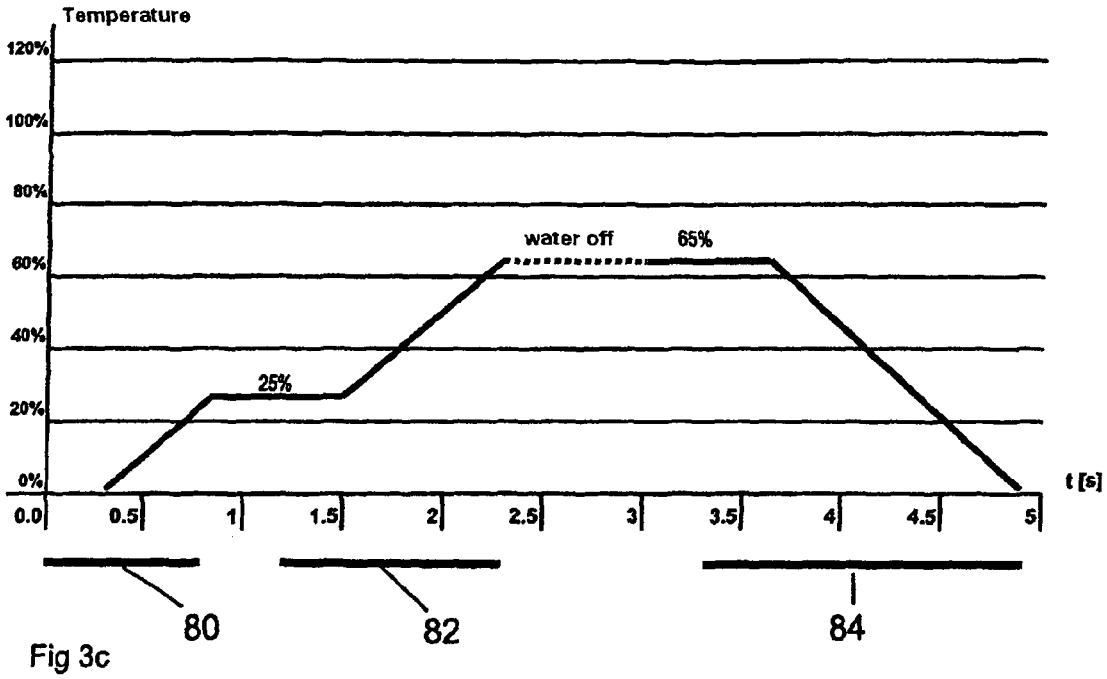
FIG. 3*c* shows a third example of a mixed water temperature profile as a function of various input signals.

FIGS. 3*a*, 3*b* and 3*c* show three different examples of time profiles of the mixed water temperature as a function of different, corresponding input signals 30. The input signals 30 generated by corresponding operation of the control signal transmitter 32 are plotted on the horizontal time axis, while the mixed water temperature is plotted in percent on the vertical axis. In this case, 0% corresponds to the temperature of the water in the cold water connection and 100% corresponds to the temperature of the water in the hot water connection.

In FIG. 3*a*, the control signal transmitter 32 is constantly, that is to say continuously, operated at the start for approximately one second in such a way that a first positive temperature signal 70 is generated as an input signal 30 to the controller 28. If the control signal transmitter 32 is in the form of a joystick 34, this is done, for example, by the operating lever 38 of the joystick 34 being deflected, at its operating lever end region 40, in one of the at least two deflection planes in a direction which corresponds to the positive temperature direction (the same applies analogously to the examples shown in FIGS. 3*b* and 3*c* too). After around 1.3 seconds, and therefore an interruption of around 0.3 seconds, a second pulse positive temperature signal 72 is generated as an input signal 30 by the control signal transmitter 32 for approximately 0.2 seconds in a pulsed manner. After around 3 seconds, and therefore an interruption of around 1.5 seconds, a first negative temperature signal 74 is constantly generated for approximately 0.7 seconds as an input signal 30 to the controller 28 by operating the control signal transmitter 32. If the control signal transmitter 32 is in the form of a joystick 34, this is done, for example, by the operating lever 38 of the joystick 34 being deflected, at its operating lever end region 40, in a direction which corresponds to the negative temperature direction (and accordingly is the opposite deflection direction to the deflection direction which corresponds to the positive temperature direction) (the same applies analogously to the examples shown in FIGS. 3*b* and 3*c* too). After approximately 4 seconds, and accordingly an interruption of around 0.3 seconds, a second negative temperature signal 76 is generated for around 0.1 seconds in a pulsed manner by operating the control signal transmitter 32.

These operations of the control signal transmitter 32 or the input signals 30 to the electrical controller 28 generated by said control signal transmitter produce the following reactions by the controller 28: the controller 28 compares each input signal 30 with a predefined and stored time value, that is to say compares the positive temperature signal with a positive temperature time value and the negative temperature signal with a negative temperature time value. In the shown design according to the invention, the stored time values are 0.3 seconds. Since the first positive temperature signal 70 with a one second duration lasts longer than the stored positive temperature time value, the mixed water temperature value rises linearly just to 35% starting from the time of 0.3 seconds, which corresponds to the positive temperature time value, and therefore over 0.7 seconds. The pulsed second positive temperature signal 72, which is shorter than the stored positive temperature time value, causes the mixed water temperature value to rise without delay to 100% after around 1.3 seconds and within around 0.3 seconds. The constant first negative temperature signal 74 after 3 seconds with a duration of approximately 0.7 seconds, which is longer than the stored negative temperature time value, causes the mixed water temperature to decrease linearly to around 80% over 0.4 seconds, starting from the elapsed time which corresponds to the negative temperature time value, as long as the negative temperature signal is present. The pulsed second negative temperature signal 76 at 4 seconds, of which the signal time duration is shorter than the stored negative temperature time value of 0.3 seconds, allows the mixed water temperature value to fall without delay to the minimum within 0.4 seconds, starting from the end of the negative temperature signal. In this example, it is assumed that the mixed water throughflow rate in the period of 0 to 5 seconds is greater than zero, for example is constant. Accordingly, only the mixed water temperature is changed.

However, if the mixed water throughflow rate is stopped over this entire time and no mixed water is dispensed, the changes made in the mixed water temperature value correspond to a mixed water temperature preselection. However, if the mixed water throughflow value is not stopped (and the controller 28 has accordingly transmitted a positive water quantity signal 56 before the described positive temperature signal and negative temperature signal), the proportional valves 24, 26 of the valve device 12 are accordingly actuated by the controller 28 each time the mixed water temperature is changed. In the process, if the mixed water temperature is to be changed at a constant mixed water throughflow rate, the first proportional valve 24 and the second proportional valve 26 are actuated in an equal but opposite manner, and therefore the first proportional valve 24 is closed or opened by a first percentage value and the second proportional valve 26 is opened or closed by a second percentage value. However, in the process, the mixed water throughflow rate always remains at least approximately constant (that is to say the sum of the percentage openings of the first proportional valve 24 and the second proportional valve 26 always has to be kept constant). The same applies analogously to the examples in FIGS. 3*b* and 3*c*.

In FIG. 3*b*, a third positive temperature signal 78 is generated in a pulsed manner by the control signal transmitter 32 as an input signal 30 to the electrical controller 28 after around one second for 0.3 seconds. This signal is compared with the positive temperature time value. Since the duration of said signal corresponds to the stored positive temperature time value, the input signal 30 causes the mixed water temperature value to rise without delay from 0% to 100% over 0.5 seconds, starting from the end of the positive temperature signal, analogously to the case with a shorter signal duration. In this example, the mixed water throughflow rate is greater than 0 over the period of 0 to 5 seconds. However, after around 5 seconds, the mixed water throughflow rate assumes the value 0, and therefore water throughflow is stopped after around 5 seconds. In this case, the set mixed water temperature value is kept stored for a certain time, in this example for approximately 30 seconds, this being indicated by the dashed line. If the water throughflow rate were to be increased over this time, the mixed water temperature would have the same temperature value as the mixed water which flowed through last. However, since the water throughflow rate is not increased within 30 seconds in this example, the mixed water temperature value is automatically reset to 0% at the time of 35 seconds.

In FIG. 3*c*, a fourth positive temperature signal 80 is constantly generated as an input signal 30 for the controller 28 at the start for approximately 0.8 seconds by operating the control signal transmitter 32. After around 1.2 seconds, and therefore after an interruption of 0.4 seconds, a fifth positive temperature signal 82 is constantly generated for approximately 1.1 seconds by operating the control signal transmitter 32. After approximately 3.3 seconds, and therefore after an interruption of around one second, a third negative temperature signal 84 is constantly generated for approximately 3.1 seconds by the control signal transmitter 32.

During the constant fourth positive temperature signal 80 which lasts around 0.8 seconds (of which the signal time duration is correspondingly longer than the stored positive temperature time value), the percentage value of the mixed water temperature rises linearly from 0% to approximately 25% starting from the time which corresponds to the time at which the positive temperature time value elapsed. The fifth constant positive temperature signal 82, which is likewise longer than the stored positive temperature time value on account of its duration of around 1.1 seconds, causes the mixed water temperature value to rise from approximately 25% to approximately 65%, starting from the delay which corresponds to the positive temperature time value, as long as the positive temperature signal is present. In this example, the mixed water throughflow rate is greater than 0 over the period of 0 to 2 seconds. However, after around 2 seconds, the mixed water throughflow rate assumes the value 0, and therefore the water throughflow is stopped after around 2 seconds (indicated by the dashed line). However, the set mixed water temperature value is kept stored for a certain time, preferably of the order of magnitude of 30 seconds. Since, in this example, in contrast to the example in FIG. 3*b*, the mixed water throughflow rate is already increased again at the time of approximately 3 seconds, the mixed water being dispensed is at the previously set and selected mixed water temperature value of 65%.

The constant, third negative temperature signal 84, which has a duration of around 1.6 seconds and is applied 3.3 seconds after the beginning, causes the percentage value of the mixed water temperature to decrease linearly with the same gradient as in the case of the linear increase, but with a negative sign, starting in a manner delayed by the negative temperature time, and therefore to assume the percentage value 0 at the end—around 4.9 seconds after the beginning.

Figure 4A:
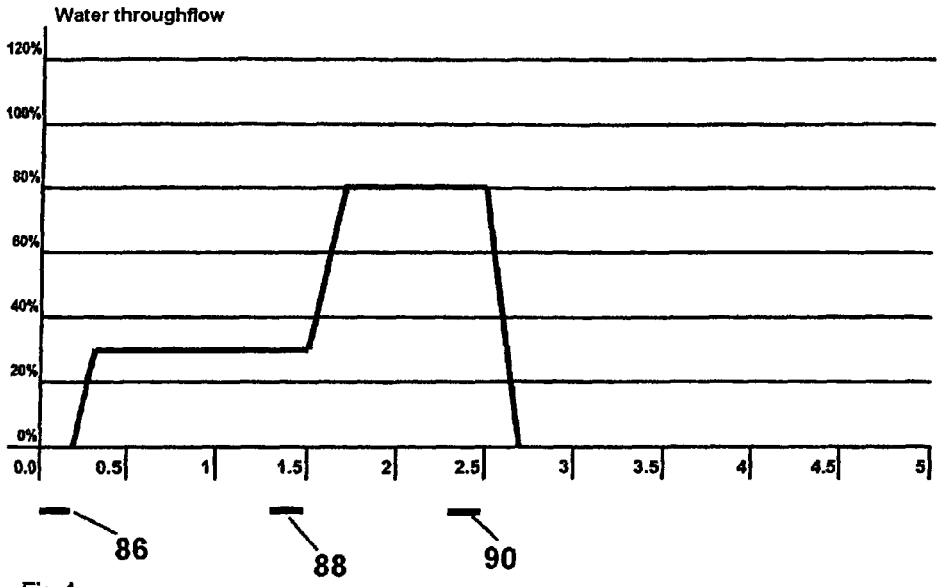
FIG. 4*a* shows a first example of a mixed water quantity throughflow profile as a function of various input signals.
Figure 4B:
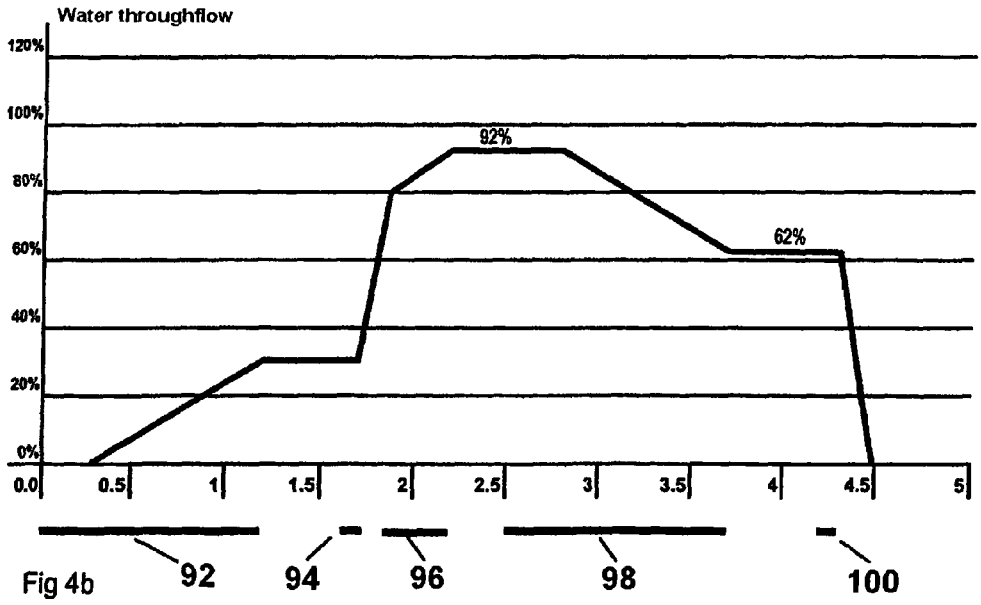
FIG. 4*b* shows a second example of a mixed water quantity throughflow profile as a function of various input signals.

FIGS. 4*a* and 4*b* show time profiles of the mixed water throughflow rate as a function of input signals 30. The input signals 30 are plotted on the horizontal time axis, while the mixed water throughflow rate is plotted in percent on the vertical axis. Analogously to temperature regulation, it should be noted that the input signals 30 have a certain lead time, between virtually 0 and a maximum of 0.3 seconds, and during this lead time the controller 28 decides whether a pulsed or a continuous input signal 30 is applied.

The output of the controller 28 does not change during this lead time when a continuous input signal 30 is applied, whereas the corresponding output signal is immediately generated at the end of a pulsed input signal 30.

In FIG. 4*a*, a first positive water quantity signal 86 to the electrical controller 28 is generated at the start for approximately 0.2 seconds by pulsed operation of the control signal transmitter 32. If the control signal transmitter 32 is in the form of a joystick 34, this is done, for example, by the operating lever 38 of the joystick 34 being deflected, at its operating lever end region 40, in a direction in a deflection plane which corresponds to the positive water quantity direction (the same applies analogously to the example shown in FIG. 4*b* too). At the time of 1.3 seconds, and therefore after an interruption of around one second, a second pulse positive water quantity signal 88 is generated for approximately 0.2 seconds in a pulsed manner. At the time of 2.3 seconds, and therefore after an interruption of around one second, a first negative water quantity signal 90 is generated for approximately 0.2 seconds in a pulsed-like manner. If the control signal transmitter 32 is in the form of a joystick 34, this is done, for example, by the operating lever 38 of the joystick 34 being deflected, at its operating lever end region 40, in a direction which corresponds to the negative water quantity direction (and accordingly is the opposite deflection direction to the deflection direction which corresponds to the positive water quantity direction) (the same applies analogously to the example shown in FIG. 4*b* too).

These operations of the control signal transmitter 32 or the input signals 30 to the electrical controller 28 generated by said control signal transmitter produce the following reactions by the controller 28: the controller 28 compares each input signal 30 with a predefined and stored time value, that is to say compares the positive water quantity signal 56 with a positive water quantity time value and the negative water quantity signal 58 with a negative water quantity time value. In the shown design according to the invention, the stored time values are 0.3 seconds. The first positive water quantity signal 86, which is shorter than the stored positive water quantity time value, causes the percentage value of the mixed water throughflow rate to rise without delay from 0% to a lower mixed water throughflow limit value, which is defined by 30% in this case for example, at the end of the positive water quantity signal 86 within 0.1 seconds. The pulsed second positive water quantity signal 88 which is likewise shorter than the stored positive water quantity time value, causes the percentage value of the mixed water throughflow rate to rise without delay from 30% to an upper mixed water throughflow limit value of 80% in this case for example, starting at the end of the positive water quantity signal 88 within 0.15 seconds. The pulsed first negative water quantity signal 90, which lasts 0.2 seconds, which is likewise shorter than the stored positive water quantity time value, causes, after around 2.3 seconds, the mixed water throughflow rate to be reduced without delay to 0%, starting at the end of the negative water quantity signal 90, within 0.24 seconds.

In this example, the mixed water throughflow rate is changed while the mixed water temperature remains constant. With each such change in the water throughflow, the electrical controller 28 also actuates the proportional valves 24, 26 of the valve device 12. In this case, if the mixed water throughflow rate is to be changed with the mixed water temperature remaining constant, the first proportional valve 24 and the second proportional valve 26 are actuated in such a way that the two valves are either opened by a first and a second opening value (in the case of the increase in the mixed water throughflow rate) or are closed by a first and a second closing value (in the case of a reduction in the mixed water throughflow rate). However, in this case, the percentage opening ratio of the first proportional valve 24 to the second proportional valve 26 always has to be kept constant in order to keep the mixed water temperature at an at least approximately constant temperature value. The same applies analogously to the example in FIG. 4*b*.

In FIG. 4*b*, a third positive water quantity signal 92 is constantly generated at the start by operating the control signal transmitter 32 for approximately 1.2 seconds. After around 1.6 seconds, and accordingly an interruption of around 0.4 seconds, a fourth positive water quantity signal 94 is generated in a pulsed manner for approximately 0.1 seconds and a constant fifth positive water quantity signal 96 is generated after just 1.9 seconds (and an interruption of around 0.27 seconds) for approximately 0.35 seconds. After around 2.8 seconds (and an interruption of around 0.3 seconds), a second negative water quantity signal 98 is constantly generated for approximately 1.2 seconds, and a fifth negative water quantity signal 100 is generated in a pulsed manner for around 0.1 seconds after 4.2 seconds (after an interruption of around 0.5 seconds).

During the constant third positive water quantity signal 92 which lasts around 1.2 seconds, of which the signal time duration is longer than the stored positive water quantity time value, the percentage value of the mixed water throughflow rate rises linearly from 0% to approximately 30%, with a delay of the duration of the positive water quantity time value, within 0.9 seconds. The fourth pulsed positive water quantity signal 94 (of which the signal time duration is likewise shorter than the stored positive water quantity time value) causes the water throughflow to rise in percent from 30% to 80%, in accordance with the upper mixed water throughflow limit value, without any delay with respect to the end of the positive water quantity signal 94 and within 0.15 seconds. The renewed fifth positive water quantity signal 96 with a duration of approximately 0.36 seconds allows the mixed water throughflow rate to rise further to around 92%. At a throughflow value of 80% and above, pulse regulation in the direction of 100% is no longer provided in this case, the input signal 30 is no longer compared with a time value, but is immediately converted and therefore there is no lead time. The input signal 30 is immediately converted. The second negative water quantity signal 98 of around 1.2 seconds causes the water throughflow to drop linearly to approximately 62%, starting with a delay which corresponds to the negative water quantity time value. The third pulsed negative water quantity signal 100 causes the mixed water throughflow rate to drop to 0% without any delay with respect to the end of the negative water quantity signal 100 and within 0.19 seconds.

In the example shown in FIGS. 3*a* to 4*b*, the temperature is changed at a rate of 100% over 0.5 seconds in the case of pulsed input signals 30, and at a rate of 100% over 2 seconds in the case of continuous input signals 30, and also the water quantity throughflow is changed at a rate of 100% over 0.3 seconds in the case of pulsed input signals 30, and at a rate of 100% over 3 seconds in the case of continuous input signals 30.

It goes without saying that the rates can also be selected to be different by corresponding programming of the controller 28.

In the exemplary embodiments shown, input signals 30 which are lower than or equal to the time value in question are judged to be pulsed signals. However, it is also possible for only input signals 30 which are lower than the time value in question to be regarded as pulsed signals.

In other embodiments, the controller 28 can be programmed in such a way that, for example, rather than the minimum value, any desired other value is selected for the above-described reset value for the mixed water temperature. In addition, it is feasible for a plurality of intermediate stages to be preset, both for setting the temperature and for the mixed water throughflow rate, it being possible for these intermediate stages to be selected by pulsed tapping of the control signal transmitter 32 (for example not only 30% and 80% but, for example, 30%, 50%, 70% and 80% in the case of the increase in the mixed water throughflow rate, and, for example, not only 100% for the mixed water temperature but 20%, 40%, 60%, 80% and 100%, for example).

The examples according to FIGS. 3*a* to 3*c* and 4*a* and 4*b* show profiles of the mixed water temperature and the mixed water throughflow rate as a function of the sequential positive water quantity input signals, negative water quantity input signals, positive temperature input signals or negative temperature input signals. These input signals are generated by the control signal transmitter 32 or the joystick 34, it being possible for the operating lever end region 40 of the joystick 34 to be deflected in two deflection planes which are at least approximately perpendicular to one another. It goes without saying that the four input signals can be combined in any desired order, and therefore, for example when water is flowing, the temperature can be changed and then the mixed water throughflow rate can be changed or reversed at the newly set temperature value.

Other embodiments in which the operating lever end region 40 of the joystick 34 can be deflected as desired are likewise feasible. This means that the input signals 30 are combinations of the four described input signals 30 and, accordingly, the mixed water temperature and the mixed water throughflow rate can be changed at the same time.

In another embodiment, it is feasible for the control signal transmitter 32 to not comprise a joystick 34 but, for example, four pushbuttons, with one of the four input signals (positive water quantity signal, negative water quantity signal, positive temperature signal or negative temperature signal) to be associated with each pushbutton.

The timer has the further task of detecting the duration of the unchanged mixed water throughflow by measuring the time for which an input signal 30 is no longer produced while a mixed water throughflow is greater than zero. After certain throughflow duration of a few minutes, the controller 28 automatically sets the throughflow to zero.

This serves to protect against unnoticed operation of the sanitary fitting and consequently against possible damage caused by flooding.

What is claimed is:

1. A sanitary fitting, comprising:

a cold water connection;

a hot water connection;

a mixed water outlet;

a valve device for setting a mixed water temperature and a mixed water throughflow rate, wherein the valve device is connected to the cold water connection and the hot water connection at one end and is connected to the mixed water outlet at the other end;

an electrical controller for actuating a valve; and a control signal transmitter for generating an input signal to the controller, wherein:

the valve is an integral constituent part of the valve device, and the controller actuates the valve device as a function of the input signal of the control signal transmitter such that a mixed water temperature and a mixed water throughflow rate are set, the input signal includes a positive water quantity signal, a negative water quantity signal, a positive temperature signal or a negative temperature signal as a function of an operation of the control signal transmitter, the controller transmits a signal for increasing the mixed water throughflow rate to the valve device based on a reception of the positive water quantity signal, transmits a signal for reducing the mixed water throughflow rate to the valve device based on a reception of the negative water quantity signal, transmits a signal for increasing the mixed water temperature to the valve device based on a reception of the positive temperature signal, and transmits a signal for reducing the mixed water temperature to the valve device based on a reception of the negative temperature signal, the controller contains a temperature memory for storing a mixed water temperature value that can be set by the control signal transmitter, a mixed water throughflow memory for storing a current mixed water throughflow rate, and a timer, the controller compares a signal time duration of the positive water quantity signal with a positive water quantity time value that is stored in a timer when said positive water quantity signal is received, and if the signal time duration is longer than the stored positive water quantity time value, the controller actuates the valve device such that the mixed water throughflow rate, at an at least approximately constant mixed water temperature in line with the mixed water temperature value stored in the temperature memory, is continuously increased until the end of the positive water quantity signal or at a time at which a maximum permissible mixed water throughflow rate is achieved, and, after the mixed water throughflow is continuously increased, the current mixed water throughflow rate is preferably stored in the mixed water throughflow memory.

2. The sanitary fitting as claimed in claim 1, wherein:

the control signal transmitter includes a joystick with an operating lever that is mounted on a base element and can be deflected out of a neutral inoperative position in two planes, which are at least approximately at right angles to one another, using an operating lever end region, and the base element is equipped with at least one sensor in order to determine the position of the operating lever relative to the neutral inoperative position and to convert the relative position into the input signal.

3. The sanitary fitting as claimed in claim 2, wherein the operating lever is equipped with a permanent magnet at an end of the operating lever, said permanent magnet interacting with Hall sensors of the sensor, which are firmly mounted with respect to the base element of the joystick.

4. The sanitary fitting as claimed in claim 2, wherein:

a positive water quantity signal is associated with a deflection plane in one deflection direction and the negative water quantity signal is associated with the deflection plane in a corresponding opposite deflection direction, and the positive temperature signal is associated with the other deflection plane in one deflection direction and the negative temperature signal is associated with said other deflection plane in the correspondingly further opposite deflection direction.

5. The sanitary fitting as claimed in claim 1, wherein:

a first valve of the valve device is a first proportional valve that is connected to the cold water connection on an intake side of the first valve and to the mixed water outlet on an outflow side of the first valve, a second valve of the valve device is a second proportional valve that is connected to the hot water connection on an intake side of the second valve and to the mixed water outlet on an outflow side of the second valve, and the controller actuates the first proportional valve with a first electrical control signal, and actuates the second proportional valve with a second electrical control signal.

6. The sanitary fitting as claimed in claim 1, wherein a light source emits light in different colors as a function of a selected mixed water temperature.

7. The sanitary fitting as claimed in claim 6, wherein the light source is mounted on the control signal transmitter or on the water discharge pipe and is a light-emitting diode (LED).

8. The sanitary fitting as claimed in claim 1, wherein the sensor interacts with a sensor end, which is averted from the operating lever end region, of the operating lever.

9. A sanitary fitting, comprising:

a cold water connection;

a hot water connection;

a mixed water outlet;

a valve device for setting a mixed water temperature and a mixed water throughflow rate, wherein the valve device is connected to the cold water connection and the hot water connection at one end and is connected to the mixed water outlet at the other end;

an electrical controller for actuating a valve; and a control signal transmitter for generating an input signal to the controller, wherein:

the valve is an integral constituent part of the valve device, and the controller actuates the valve device as a function of the input signal of the control signal transmitter such that a mixed water temperature and a mixed water throughflow rate are set, the input signal includes a positive water quantity signal, a negative water quantity signal, a positive temperature signal or a negative temperature signal as a function of an operation of the control signal transmitter, the controller transmits a signal for increasing the mixed water throughflow rate to the valve device based on a reception of the positive water quantity signal, transmits a signal for reducing the mixed water throughflow rate to the valve device based on a reception of the negative water quantity signal, transmits a signal for increasing the mixed water temperature to the valve device based on a reception of the positive temperature signal, and transmits a signal for reducing the mixed water temperature to the valve device based on a reception of the negative temperature signal, the controller contains a temperature memory for storing a mixed water temperature value that can be set by the control signal transmitter, a mixed water throughflow memory for storing a current mixed water throughflow rate, and a timer, the controller compares the signal time duration of the negative water quantity signal with a negative water quantity time value that is stored in a timer when said negative water quantity signal is received, and if the signal time duration is longer than the stored negative water quantity time value, the controller actuates the valve device such that the mixed water throughflow rate, at an at least approximately constant mixed water temperature in line with the mixed water temperature value stored in the temperature memory, is continuously reduced until the end of the negative water quantity signal or at a time at which the mixed water throughflow rate has reached the value zero.

10. The sanitary fitting as claimed in claim 9, wherein:

the control signal transmitter includes a joystick with an operating lever that is mounted on a base element and can be deflected out of a neutral inoperative position in two planes, which are at least approximately at right angles to one another, using an operating lever end region, and the base element is equipped with at least one sensor in order to determine the position of the operating lever relative to the neutral inoperative position and to convert the relative position into the input signal.

11. The sanitary fitting as claimed in claim 10, wherein the operating lever is equipped with a permanent magnet at an end of the operating lever, said permanent magnet interacting with Hall sensors of the sensor, which are firmly mounted with respect to the base element of the joystick.

12. The sanitary fitting as claimed in claim 10, wherein the sensor interacts with a sensor end, which is averted from the operating lever end region, of the operating lever.

13. The sanitary fitting as claimed in claim 10, wherein:

a positive water quantity signal is associated with a deflection plane in one deflection direction and the negative water quantity signal is associated with the deflection plane in a corresponding opposite deflection direction, and the positive temperature signal is associated with the other deflection plane in one deflection direction and the negative temperature signal is associated with said other deflection plane in the correspondingly further opposite deflection direction.

14. The sanitary fitting as claimed in claim 9, wherein:

a first valve of the valve device is a first proportional valve that is connected to the cold water connection on an intake side of the first valve and to the mixed water outlet on an outflow side of the first valve, a second valve of the valve device is a second proportional valve that is connected to the hot water connection on an intake side of the second valve and to the mixed water outlet on an outflow side of the second valve, and the controller actuates the first proportional valve with a first electrical control signal, and actuates the second proportional valve with a second electrical control signal.

15. The sanitary fitting as claimed in claim 9, wherein a light source emits light in different colors as a function of a selected mixed water temperature.

16. The sanitary fitting as claimed in claim 15, wherein the light source is mounted on the control signal transmitter or on the water discharge pipe and is a light-emitting diode (LED).

17. The sanitary fitting as claimed in claim 9, wherein after the continuous reduction in the mixed water throughflow rate, the current mixed water throughflow rate is stored in the mixed water throughflow memory.

18. A sanitary fitting, comprising:

a cold water connection;

a hot water connection;

a mixed water outlet;

a valve device for setting a mixed water temperature and a mixed water throughflow rate, wherein the valve device is connected to the cold water connection and the hot water connection at one end and is connected to the mixed water outlet at the other end;

an electrical controller for actuating a valve; and a control signal transmitter for generating an input signal to the controller, wherein:

the valve is an integral constituent part of the valve device, and the controller actuates the valve device as a function of the input signal of the control signal transmitter such that a mixed water temperature and a mixed water throughflow rate are set, the input signal includes a positive water quantity signal, a negative water quantity signal, a positive temperature signal or a negative temperature signal as a function of an operation of the control signal transmitter, the controller transmits a signal for increasing the mixed water throughflow rate to the valve device based on a reception of the positive water quantity signal, transmits a signal for reducing the mixed water throughflow rate to the valve device based on a reception of the negative water quantity signal, transmits a signal for increasing the mixed water temperature to the valve device based on a reception of the positive temperature signal, and transmits a signal for reducing the mixed water temperature to the valve device based on a reception of the negative temperature signal, the controller contains a temperature memory for storing a mixed water temperature value that can be set by the control signal transmitter, a mixed water throughflow memory for storing a current mixed water throughflow rate, and a timer, the controller compares the signal time duration of the positive water quantity signal with a positive water quantity time value stored in a timer when said positive water quantity signal is received, and if the signal time duration is shorter than or equal to the stored positive water quantity time value and the current mixed water throughflow rate in line with the value stored in the mixed water throughflow memory is less than a lower mixed water throughflow limit value, the controller actuates the valve device such that the mixed water throughflow rate is increased without delay such that the mixed water temperature at least approximately corresponds to the mixed water temperature value stored in the temperature memory, and the mixed water throughflow rate corresponds to the lower mixed water throughflow limit value, and, at the end of the immediate increase in the mixed water throughflow rate, the current mixed water throughflow rate is preferably stored in the mixed water throughflow memory.

19. The sanitary fitting as claimed in claim 18, wherein:

the control signal transmitter includes a joystick with an operating lever that is mounted on a base element and can be deflected out of a neutral inoperative position in two planes, which are at least approximately at right angles to one another, using an operating lever end region, and the base element is equipped with at least one sensor in order to determine the position of the operating lever relative to the neutral inoperative position and to convert the relative position into the input signal.

20. The sanitary fitting as claimed in claim 19, wherein the operating lever is equipped with a permanent magnet at an end of the operating lever, said permanent magnet interacting with Hall sensors of the sensor, which are firmly mounted with respect to the base element of the joystick.

21. The sanitary fitting as claimed in claim 19, wherein the sensor interacts with a sensor end, which is averted from the operating lever end region, of the operating lever.

22. The sanitary fitting as claimed in claim 19, wherein:

a positive water quantity signal is associated with a deflection plane in one deflection direction and the negative water quantity signal is associated with the deflection plane in a corresponding opposite deflection direction, and the positive temperature signal is associated with the other deflection plane in one deflection direction and the negative temperature signal is associated with said other deflection plane in the correspondingly further opposite deflection direction.

23. The sanitary fitting as claimed in claim 18, wherein:

a first valve of the valve device is a first proportional valve that is connected to the cold water connection on an intake side of the first valve and to the mixed water outlet on an outflow side of the first valve, a second valve of the valve device is a second proportional valve that is connected to the hot water connection on an intake side of the second valve and to the mixed water outlet on an outflow side of the second valve, and the controller actuates the first proportional valve with a first electrical control signal, and actuates the second proportional valve with a second electrical control signal.

24. The sanitary fitting as claimed in claim 18, wherein a light source emits light in different colors as a function of a selected mixed water temperature.

25. The sanitary fitting as claimed in claim 24, wherein the light source is mounted on the control signal transmitter or on the water discharge pipe and is a light-emitting diode (LED).

26. A sanitary fitting, comprising:

a cold water connection;

a hot water connection;

a mixed water outlet;

a valve device for setting a mixed water temperature and a mixed water throughflow rate, wherein the valve device is connected to the cold water connection and the hot water connection at one end and is connected to the mixed water outlet at the other end;

an electrical controller for actuating a valve; and a control signal transmitter for generating an input signal to the controller, wherein:

the valve is an integral constituent part of the valve device, and the controller actuates the valve device as a function of the input signal of the control signal transmitter such that a mixed water temperature and a mixed water throughflow rate are set, the input signal includes a positive water quantity signal, a negative water quantity signal, a positive temperature signal or a negative temperature signal as a function of an operation of the control signal transmitter, the controller transmits a signal for increasing the mixed water throughflow rate to the valve device based on a reception of the positive water quantity signal, transmits a signal for reducing the mixed water throughflow rate to the valve device based on a reception of the negative water quantity signal, transmits a signal for increasing the mixed water temperature to the valve device based on a reception of the positive temperature signal, and transmits a signal for reducing the mixed water temperature to the valve device based on a reception of the negative temperature signal, the controller contains a temperature memory for storing a mixed water temperature value that can be set by the control signal transmitter, a mixed water throughflow memory for storing a current mixed water throughflow rate, and a timer, the controller compares the signal time duration of the positive water quantity signal with a positive water quantity time value stored in a timer when said positive water quantity signal is received, and if the signal time duration is shorter than or equal to the stored positive water quantity time value and the current mixed water throughflow rate in line with the value stored in the mixed water throughflow memory is greater than or equal to the lower mixed water throughflow limit value and less than an upper mixed water throughflow limit value, the controller actuates the valve device such that the mixed water throughflow rate is increased without delay such that the mixed water temperature corresponds to the mixed water temperature value stored in the temperature memory and the mixed water throughflow at least approximately corresponds to the upper mixed water throughflow value.

27. The sanitary fitting as claimed in claim 26, wherein:

the control signal transmitter includes a joystick with an operating lever that is mounted on a base element and can be deflected out of a neutral inoperative position in two planes, which are at least approximately at right angles to one another, using an operating lever end region, and the base element is equipped with at least one sensor in order to determine the position of the operating lever relative to the neutral inoperative position and to convert the relative position into the input signal.

28. The sanitary fitting as claimed in claim 27, wherein the operating lever is equipped with a permanent magnet at an end of the operating lever, said permanent magnet interacting with Hall sensors of the sensor, which are firmly mounted with respect to the base element of the joystick.

29. The sanitary fitting as claimed in claim 27, wherein the sensor interacts with a sensor end, which is averted from the operating lever end region, of the operating lever.

30. The sanitary fitting as claimed in claim 27, wherein:

a positive water quantity signal is associated with a deflection plane in one deflection direction and the negative water quantity signal is associated with the deflection plane in a corresponding opposite deflection direction, and the positive temperature signal is associated with the other deflection plane in one deflection direction and the negative temperature signal is associated with said other deflection plane in the correspondingly further opposite deflection direction.

31. The sanitary fitting as claimed in claim 26, wherein:

a first valve of the valve device is a first proportional valve that is connected to the cold water connection on an intake side of the first valve and to the mixed water outlet on an outflow side of the first valve, a second valve of the valve device is a second proportional valve that is connected to the hot water connection on an intake side of the second valve and to the mixed water outlet on an outflow side of the second valve, and the controller actuates the first proportional valve with a first electrical control signal, and actuates the second proportional valve with a second electrical control signal.

32. The sanitary fitting as claimed in claim 26, wherein a light source emits light in different colors as a function of a selected mixed water temperature.

33. The sanitary fitting as claimed in claim 32, wherein the light source is mounted on the control signal transmitter or on the water discharge pipe and is a light-emitting diode (LED).

34. A sanitary fitting, comprising:

a cold water connection;

a hot water connection;

a mixed water outlet;

a valve device for setting a mixed water temperature and a mixed water throughflow rate, wherein the valve device is connected to the cold water connection and the hot water connection at one end and is connected to the mixed water outlet at the other end;

an electrical controller for actuating a valve; and a control signal transmitter for generating an input signal to the controller, wherein:

the valve is an integral constituent part of the valve device, and the controller actuates the valve device as a function of the input signal of the control signal transmitter such that a mixed water temperature and a mixed water throughflow rate are set, the input signal includes a positive water quantity signal, a negative water quantity signal, a positive temperature signal or a negative temperature signal as a function of an operation of the control signal transmitter, the controller transmits a signal for increasing the mixed water throughflow rate to the valve device based on a reception of the positive water quantity signal, transmits a signal for reducing the mixed water throughflow rate to the valve device based on a reception of the negative water quantity signal, transmits a signal for increasing the mixed water temperature to the valve device based on a reception of the positive temperature signal, and transmits a signal for reducing the mixed water temperature to the valve device based on a reception of the negative temperature signal, the controller contains a temperature memory for storing a mixed water temperature value that can be set by the control signal transmitter, a mixed water throughflow memory for storing a current mixed water throughflow rate, and a timer, the controller compares the signal time duration of the negative water quantity signal with a negative water quantity time value stored in a timer when said negative water quantity signal is received, and if the signal time duration is shorter than or equal to the stored negative water quantity time value, the controller actuates the valve device such that the mixed water throughflow rate is reduced without delay such that the mixed water throughflow rate reaches the value zero.

35. The sanitary fitting as claimed in claim 34, wherein:

the control signal transmitter includes a joystick with an operating lever that is mounted on a base element and can be deflected out of a neutral inoperative position in two planes, which are at least approximately at right angles to one another, using an operating lever end region, and the base element is equipped with at least one sensor in order to determine the position of the operating lever relative to the neutral inoperative position and to convert the relative position into the input signal.

36. The sanitary fitting as claimed in claim 35, wherein the operating lever is equipped with a permanent magnet at an end of the operating lever, said permanent magnet interacting with Hall sensors of the sensor, which are firmly mounted with respect to the base element of the joystick.

37. The sanitary fitting as claimed in claim 35, wherein the sensor interacts with a sensor end, which is averted from the operating lever end region, of the operating lever.

38. The sanitary fitting as claimed in claim 35, wherein:

a positive water quantity signal is associated with a deflection plane in one deflection direction and the negative water quantity signal is associated with the deflection plane in a corresponding opposite deflection direction, and the positive temperature signal is associated with the other deflection plane in one deflection direction and the negative temperature signal is associated with said other deflection plane in the correspondingly further opposite deflection direction.

39. The sanitary fitting as claimed in claim 34, wherein:

a first valve of the valve device is a first proportional valve that is connected to the cold water connection on an intake side of the first valve and to the mixed water outlet on an outflow side of the first valve, a second valve of the valve device is a second proportional valve that is connected to the hot water connection on an intake side of the second valve and to the mixed water outlet on an outflow side of the second valve, and the controller actuates the first proportional valve with a first electrical control signal, and actuates the second proportional valve with a second electrical control signal.

40. The sanitary fitting as claimed in claim 34, wherein a light source emits light in different colors as a function of a selected mixed water temperature.

41. The sanitary fitting as claimed in claim 40, wherein the light source is mounted on the control signal transmitter or on the water discharge pipe and is a light-emitting diode (LED).

42. The sanitary fitting as claimed in claim 34, wherein at the end of the immediate reduction in the mixed water throughflow rate, a value zero for the current mixed water throughflow rate is stored in the mixed water throughflow memory.

43. A sanitary fitting, comprising:

a cold water connection;

a hot water connection;

a mixed water outlet;

a valve device for setting a mixed water temperature and a mixed water throughflow rate, wherein the valve device is connected to the cold water connection and the hot water connection at one end and is connected to the mixed water outlet at the other end;

an electrical controller for actuating a valve; and a control signal transmitter for generating an input signal to the controller, wherein:

the valve is an integral constituent part of the valve device, and the controller actuates the valve device as a function of the input signal of the control signal transmitter such that a mixed water temperature and a mixed water throughflow rate are set, the input signal includes a positive water quantity signal, a negative water quantity signal, a positive temperature signal or a negative temperature signal as a function of an operation of the control signal transmitter, the controller transmits a signal for increasing the mixed water throughflow rate to the valve device based on a reception of the positive water quantity signal, transmits a signal for reducing the mixed water throughflow rate to the valve device based on a reception of the negative water quantity signal, transmits a signal for increasing the mixed water temperature to the valve device based on a reception of the positive temperature signal, and transmits a signal for reducing the mixed water temperature to the valve device based on a reception of the negative temperature signal, the controller contains a temperature memory for storing a mixed water temperature value that can be set by the control signal transmitter, a mixed water throughflow memory for storing a current mixed water throughflow rate, and a timer, the controller compares the signal time duration of the positive temperature signal with a positive temperature time value stored in a timer when said positive temperature signal is received, and if the signal time duration is longer than the stored time value and the current mixed water throughflow rate in line with the value stored in the mixed water throughflow memory is zero, the controller continuously increases the mixed water temperature value in the temperature memory until the end of the positive temperature signal or until the mixed water temperature value has reached an upper temperature limit value.

44. The sanitary fitting as claimed in claim 43, wherein:

the control signal transmitter includes a joystick with an operating lever that is mounted on a base element and can be deflected out of a neutral inoperative position in two planes, which are at least approximately at right angles to one another, using an operating lever end region, and the base element is equipped with at least one sensor in order to determine the position of the operating lever relative to the neutral inoperative position and to convert the relative position into the input signal.

45. The sanitary fitting as claimed in claim 44, wherein the operating lever is equipped with a permanent magnet at an end of the operating lever, said permanent magnet interacting with Hall sensors of the sensor, which are firmly mounted with respect to the base element of the joystick.

46. The sanitary fitting as claimed in claim 44, wherein the sensor interacts with a sensor end, which is averted from the operating lever end region, of the operating lever.

47. The sanitary fitting as claimed in claim 44, wherein:

a positive water quantity signal is associated with a deflection plane in one deflection direction and the negative water quantity signal is associated with the deflection plane in a corresponding opposite deflection direction, and the positive temperature signal is associated with the other deflection plane in one deflection direction and the negative temperature signal is associated with said other deflection plane in the correspondingly further opposite deflection direction.

48. The sanitary fitting as claimed in claim 43, wherein:

a first valve of the valve device is a first proportional valve that is connected to the cold water connection on an intake side of the first valve and to the mixed water outlet on an outflow side of the first valve, a second valve of the valve device is a second proportional valve that is connected to the hot water connection on an intake side of the second valve and to the mixed water outlet on an outflow side of the second valve, and the controller actuates the first proportional valve with a first electrical control signal, and actuates the second proportional valve with a second electrical control signal.

49. The sanitary fitting as claimed in claim 43, wherein a light source emits light in different colors as a function of a selected mixed water temperature.

50. The sanitary fitting as claimed in claim 49, wherein the light source is mounted on the control signal transmitter or on the water discharge pipe and is a light-emitting diode (LED).

51. The sanitary fitting as claimed in claim 43, wherein at the end of the continuous increase in the mixed water temperature value, the current mixed water temperature value is stored in the temperature memory.

52. A sanitary fitting, comprising:

a cold water connection;

a hot water connection;

a mixed water outlet;

a valve device for setting a mixed water temperature and a mixed water throughflow rate, wherein the valve device is connected to the cold water connection and the hot water connection at one end and is connected to the mixed water outlet at the other end;

an electrical controller for actuating a valve; and a control signal transmitter for generating an input signal to the controller, wherein:

the valve is an integral constituent part of the valve device, and the controller actuates the valve device as a function of the input signal of the control signal transmitter such that a mixed water temperature and a mixed water throughflow rate are set, the input signal includes a positive water quantity signal, a negative water quantity signal, a positive temperature signal or a negative temperature signal as a function of an operation of the control signal transmitter, the controller transmits a signal for increasing the mixed water throughflow rate to the valve device based on a reception of the positive water quantity signal, transmits a signal for reducing the mixed water throughflow rate to the valve device based on a reception of the negative water quantity signal, transmits a signal for increasing the mixed water temperature to the valve device based on a reception of the positive temperature signal, and transmits a signal for reducing the mixed water temperature to the valve device based on a reception of the negative temperature signal, the controller contains a temperature memory for storing a mixed water temperature value that can be set by the control signal transmitter, a mixed water throughflow memory for storing a current mixed water throughflow rate, and a timer, the controller compares the signal time duration of the positive temperature signal with a positive temperature time value stored in a timer when said positive temperature signal is received, and if the signal time duration is longer than the stored positive temperature time value and the current mixed water throughflow rate in line with the value stored in the mixed water throughflow memory is greater than zero, the controller continuously increases the mixed water temperature value in the temperature memory until the end of the positive temperature signal or until the mixed water temperature value has reached the upper temperature limit value, and at the same time actuates the valve unit in such a way that the mixed water temperature is adapted in accordance with the mixed water temperature value with an at least approximately constant mixed water throughflow rate.

53. The sanitary fitting as claimed in claim 52, wherein:

the control signal transmitter includes a joystick with an operating lever that is mounted on a base element and can be deflected out of a neutral inoperative position in two planes, which are at least approximately at right angles to one another, using an operating lever end region, and the base element is equipped with at least one sensor in order to determine the position of the operating lever relative to the neutral inoperative position and to convert the relative position into the input signal.

54. The sanitary fitting as claimed in claim 53, wherein the operating lever is equipped with a permanent magnet at an end of the operating lever, said permanent magnet interacting with Hall sensors of the sensor, which are firmly mounted with respect to the base element of the joystick.

55. The sanitary fitting as claimed in claim 53, wherein the sensor interacts with a sensor end, which is averted from the operating lever end region, of the operating lever.

56. The sanitary fitting as claimed in claim 53, wherein:

a positive water quantity signal is associated with a deflection plane in one deflection direction and the negative water quantity signal is associated with the deflection plane in a corresponding opposite deflection direction, and the positive temperature signal is associated with the other deflection plane in one deflection direction and the negative temperature signal is associated with said other deflection plane in the correspondingly further opposite deflection direction.

57. The sanitary fitting as claimed in claim 52, wherein:

a first valve of the valve device is a first proportional valve that is connected to the cold water connection on an intake side of the first valve and to the mixed water outlet on an outflow side of the first valve, a second valve of the valve device is a second proportional valve that is connected to the hot water connection on an intake side of the second valve and to the mixed water outlet on an outflow side of the second valve, and the controller actuates the first proportional valve with a first electrical control signal, and actuates the second proportional valve with a second electrical control signal.

58. The sanitary fitting as claimed in claim 52, wherein a light source emits light in different colors as a function of a selected mixed water temperature.

59. The sanitary fitting as claimed in claim 58, wherein the light source is mounted on the control signal transmitter or on the water discharge pipe and is a light-emitting diode (LED).

60. The sanitary fitting as claimed in claim 52, wherein at the end of the continuous increase in the mixed water temperature value, the current mixed water temperature value is stored in the temperature memory.

61. A sanitary fitting, comprising:

a cold water connection;

a hot water connection;

a mixed water outlet;

a valve device for setting a mixed water temperature and a mixed water throughflow rate, wherein the valve device is connected to the cold water connection and the hot water connection at one end and is connected to the mixed water outlet at the other end;

an electrical controller for actuating a valve; and a control signal transmitter for generating an input signal to the controller, wherein:

the valve is an integral constituent part of the valve device, and the controller actuates the valve device as a function of the input signal of the control signal transmitter such that a mixed water temperature and a mixed water throughflow rate are set, the input signal includes a positive water quantity signal, a negative water quantity signal, a positive temperature signal or a negative temperature signal as a function of an operation of the control signal transmitter, the controller transmits a signal for increasing the mixed water throughflow rate to the valve device based on a reception of the positive water quantity signal, transmits a signal for reducing the mixed water throughflow rate to the valve device based on a reception of the negative water quantity signal, transmits a signal for increasing the mixed water temperature to the valve device based on a reception of the positive temperature signal, and transmits a signal for reducing the mixed water temperature to the valve device based on a reception of the negative temperature signal, the controller contains a temperature memory for storing a mixed water temperature value that can be set by the control signal transmitter, a mixed water throughflow memory for storing a current mixed water throughflow rate, and a timer, the controller compares the signal time duration of the positive temperature signal with a positive temperature time value stored in a timer when said positive temperature signal is received, and if the signal time duration is shorter than or equal to the stored time value and the current mixed water throughflow rate in line with the value stored in the mixed water throughflow memory is zero, the controller sets the mixed water temperature value in the temperature memory to an upper temperature limit value.

62. The sanitary fitting as claimed in claim 61, wherein:

the control signal transmitter includes a joystick with an operating lever that is mounted on a base element and can be deflected out of a neutral inoperative position in two planes, which are at least approximately at right angles to one another, using an operating lever end region, and the base element is equipped with at least one sensor in order to determine the position of the operating lever relative to the neutral inoperative position and to convert the relative position into the input signal.

63. The sanitary fitting as claimed in claim 62, wherein the operating lever is equipped with a permanent magnet at an end of the operating lever, said permanent magnet interacting with Hall sensors of the sensor, which are firmly mounted with respect to the base element of the joystick.

64. The sanitary fitting as claimed in claim 62, wherein the sensor interacts with a sensor end, which is averted from the operating lever end region, of the operating lever.

65. The sanitary fitting as claimed in claim 62, wherein:

a positive water quantity signal is associated with a deflection plane in one deflection direction and the negative water quantity signal is associated with the deflection plane in a corresponding opposite deflection direction, and the positive temperature signal is associated with the other deflection plane in one deflection direction and the negative temperature signal is associated with said other deflection plane in the correspondingly further opposite deflection direction.

66. The sanitary fitting as claimed in claim 61, wherein:

a first valve of the valve device is a first proportional valve that is connected to the cold water connection on an intake side of the first valve and to the mixed water outlet on an outflow side of the first valve, a second valve of the valve device is a second proportional valve that is connected to the hot water connection on an intake side of the second valve and to the mixed water outlet on an outflow side of the second valve, and the controller actuates the first proportional valve with a first electrical control signal, and actuates the second proportional valve with a second electrical control signal.

67. The sanitary fitting as claimed in claim 61, wherein a light source emits light in different colors as a function of a selected mixed water temperature.

68. The sanitary fitting as claimed in claim 67, wherein the light source is mounted on the control signal transmitter or on the water discharge pipe and is a light-emitting diode (LED).

69. The sanitary fitting as claimed in claim 61, wherein the controller stores said mixed water temperature value.

70. A sanitary fitting, comprising:
a cold water connection;
a hot water connection;
a mixed water outlet;
a valve device for setting a mixed water temperature and a mixed water throughflow rate, wherein the valve device is connected to the cold water connection and the hot water connection at one end and is connected to the mixed water outlet at the other end;
an electrical controller for actuating a valve; and
a control signal transmitter for generating an input signal to the controller, wherein:
the valve is an integral constituent part of the valve device, and the controller actuates the valve device as a function of the input signal of the control signal transmitter such that a mixed water temperature and a mixed water throughflow rate are set,
the input signal includes a positive water quantity signal, a negative water quantity signal, a positive temperature signal or a negative temperature signal as a function of an operation of the control signal transmitter,
the controller transmits a signal for increasing the mixed water throughflow rate to the valve device based on a reception of the positive water quantity signal, transmits a signal for reducing the mixed water throughflow rate to the valve device based on a reception of the negative water quantity signal, transmits a signal for increasing the mixed water temperature to the valve device based on a reception of the positive temperature signal, and transmits a signal for reducing the mixed water temperature to the valve device based on a reception of the negative temperature signal,
the controller contains a temperature memory for storing a mixed water temperature value that can be set by the control signal transmitter, a mixed water throughflow memory for storing a current mixed water throughflow rate, and a timer,
the controller compares the signal time duration of the positive temperature signal with a positive temperature time value stored in a timer when said positive temperature signal is received, and
if the signal time duration is shorter than or equal to the stored positive temperature time value and the current mixed water throughflow rate in line with the value stored in the mixed water throughflow memory is greater than zero, the controller sets the mixed water temperature value in the temperature memory to an upper temperature limit value and, at the same time, actuates the valve unit in such a way that the mixed water temperature is adapted in accordance with the mixed water temperature value with an at least approximately constant mixed water throughflow rate.

71. The sanitary fitting as claimed in claim 70, wherein:
the control signal transmitter includes a joystick with an operating lever that is mounted on a base element and can be deflected out of a neutral inoperative position in two planes, which are at least approximately at right angles to one another, using an operating lever end region, and
the base element is equipped with at least one sensor in order to determine the position of the operating lever relative to the neutral inoperative position and to convert the relative position into the input signal.

72. The sanitary fitting as claimed in claim 71, wherein the operating lever is equipped with a permanent magnet at an end of the operating lever, said permanent magnet interacting with Hall sensors of the sensor, which are firmly mounted with respect to the base element of the joystick.

73. The sanitary fitting as claimed in claim 71, wherein the sensor interacts with a sensor end, which is averted from the operating lever end region, of the operating lever.

74. The sanitary fitting as claimed in claim 71, wherein:
a positive water quantity signal is associated with a deflection plane in one deflection direction and the negative water quantity signal is associated with the deflection plane in a corresponding opposite deflection direction, and
the positive temperature signal is associated with the other deflection plane in one deflection direction and the negative temperature signal is associated with said other deflection plane in the correspondingly further opposite deflection direction.

75. The sanitary fitting as claimed in claim 70, wherein:
a first valve of the valve device is a first proportional valve that is connected to the cold water connection on an intake side of the first valve and to the mixed water outlet on an outflow side of the first valve,
a second valve of the valve device is a second proportional valve that is connected to the hot water connection on an intake side of the second valve and to the mixed water outlet on an outflow side of the second valve, and
the controller actuates the first proportional valve with a first electrical control signal, and actuates the second proportional valve with a second electrical control signal.

76. The sanitary fitting as claimed in claim 70, wherein a light source emits light in different colors as a function of a selected mixed water temperature.

77. The sanitary fitting as claimed in claim 76, wherein the light source is mounted on the control signal transmitter or on the water discharge pipe and is a light-emitting diode (LED).

78. A sanitary fitting, comprising:
a cold water connection;
a hot water connection;
a mixed water outlet;
a valve device for setting a mixed water temperature and a mixed water throughflow rate, wherein the valve device is connected to the cold water connection and the hot water connection at one end and is connected to the mixed water outlet at the other end;
an electrical controller for actuating a valve; and
a control signal transmitter for generating an input signal to the controller, wherein:
the valve is an integral constituent part of the valve device, and the controller actuates the valve device as a function of the input signal of the control signal transmitter such that a mixed water temperature and a mixed water throughflow rate are set,
the input signal includes a positive water quantity signal, a negative water quantity signal, a positive temperature signal or a negative temperature signal as a function of an operation of the control signal transmitter,
the controller transmits a signal for increasing the mixed water throughflow rate to the valve device based on a reception of the positive water quantity signal, transmits a signal for reducing the mixed water throughflow rate to the valve device based on a reception of the negative water quantity signal, transmits a signal for increasing the mixed water temperature to the valve device based on a reception of the positive temperature signal, and transmits a signal for reducing the mixed water temperature to the valve device based on a reception of the negative temperature signal, the controller contains a temperature memory for storing a mixed water temperature value that can be set by the control signal transmitter, a mixed water throughflow memory for storing a current mixed water throughflow rate, and a timer, the controller compares the signal time duration of the negative temperature signal with a negative temperature time value stored in a timer when said negative temperature signal is received, and if the signal time duration is longer than the stored negative temperature time value and the current mixed water throughflow rate in line with the value stored in the mixed water throughflow memory is zero, the controller continuously reduces the mixed water temperature value in the temperature memory until the end of the negative temperature signal or until the mixed water temperature value has reached a lower temperature limit value.

79. The sanitary fitting as claimed in claim 78, wherein:

the control signal transmitter includes a joystick with an operating lever that is mounted on a base element and can be deflected out of a neutral inoperative position in two planes, which are at least approximately at right angles to one another, using an operating lever end region, and the base element is equipped with at least one sensor in order to determine the position of the operating lever relative to the neutral inoperative position and to convert the relative position into the input signal.

80. The sanitary fitting as claimed in claim 79, wherein the operating lever is equipped with a permanent magnet at an end of the operating lever, said permanent magnet interacting with Hall sensors of the sensor, which are firmly mounted with respect to the base element of the joystick.

81. The sanitary fitting as claimed in claim 79, wherein the sensor interacts with a sensor end, which is averted from the operating lever end region, of the operating lever.

82. The sanitary fitting as claimed in claim 79, wherein:

a positive water quantity signal is associated with a deflection plane in one deflection direction and the negative water quantity signal is associated with the deflection plane in a corresponding opposite deflection direction, and the positive temperature signal is associated with the other deflection plane in one deflection direction and the negative temperature signal is associated with said other deflection plane in the correspondingly further opposite deflection direction.

83. The sanitary fitting as claimed in claim 78, wherein:

a first valve of the valve device is a first proportional valve that is connected to the cold water connection on an intake side of the first valve and to the mixed water outlet on an outflow side of the first valve, a second valve of the valve device is a second proportional valve that is connected to the hot water connection on an intake side of the second valve and to the mixed water outlet on an outflow side of the second valve, and the controller actuates the first proportional valve with a first electrical control signal, and actuates the second proportional valve with a second electrical control signal.

84. The sanitary fitting as claimed in claim 78, wherein a light source emits light in different colors as a function of a selected mixed water temperature.

85. The sanitary fitting as claimed in claim 84, wherein the light source is mounted on the control signal transmitter or on the water discharge pipe and is a light-emitting diode (LED).

86. The sanitary fitting as claimed in claim 78, wherein at the end of the continuous reduction in the mixed water temperature value, the current mixed water temperature value is stored in the temperature memory for a defined time.

87. A sanitary fitting, comprising:

a cold water connection;

a hot water connection;

a mixed water outlet;

a valve device for setting a mixed water temperature and a mixed water throughflow rate, wherein the valve device is connected to the cold water connection and the hot water connection at one end and is connected to the mixed water outlet at the other end;

an electrical controller for actuating a valve; and a control signal transmitter for generating an input signal to the controller, wherein:

the valve is an integral constituent part of the valve device, and the controller actuates the valve device as a function of the input signal of the control signal transmitter such that a mixed water temperature and a mixed water throughflow rate are set, the input signal includes a positive water quantity signal, a negative water quantity signal, a positive temperature signal or a negative temperature signal as a function of an operation of the control signal transmitter, the controller transmits a signal for increasing the mixed water throughflow rate to the valve device based on a reception of the positive water quantity signal, transmits a signal for reducing the mixed water throughflow rate to the valve device based on a reception of the negative water quantity signal, transmits a signal for increasing the mixed water temperature to the valve device based on a reception of the positive temperature signal, and transmits a signal for reducing the mixed water temperature to the valve device based on a reception of the negative temperature signal, the controller contains a temperature memory for storing a mixed water temperature value that can be set by the control signal transmitter, a mixed water throughflow memory for storing a current mixed water throughflow rate, and a timer, the controller compares the signal time duration of the negative temperature signal with a negative temperature time value stored in the timer when said negative temperature signal is received, and if the signal time duration is longer than the stored time value and the current mixed water throughflow rate in line with the value stored in the mixed water throughflow memory is greater than zero, the controller continuously reduces the mixed water temperature value in the temperature memory until the end of the negative temperature signal or until the mixed water temperature value has reached a lower temperature limit value, and, at the same time, actuates the valve unit in such a way that the mixed water temperature is continuously adapted in accordance with the mixed water temperature value with an at least approximately constant mixed water throughflow rate.

88. The sanitary fitting as claimed in claim 87, wherein:

the control signal transmitter includes a joystick with an operating lever that is mounted on a base element and can be deflected out of a neutral inoperative position in two planes, which are at least approximately at right angles to one another, using an operating lever end region, and the base element is equipped with at least one sensor in order to determine the position of the operating lever relative to the neutral inoperative position and to convert the relative position into the input signal.

89. The sanitary fitting as claimed in claim 88, wherein the operating lever is equipped with a permanent magnet at an end of the operating lever, said permanent magnet interacting with Hall sensors of the sensor, which are firmly mounted with respect to the base element of the joystick.

90. The sanitary fitting as claimed in claim 88, wherein the sensor interacts with a sensor end, which is averted from the operating lever end region, of the operating lever.

91. The sanitary fitting as claimed in claim 88, wherein:

a positive water quantity signal is associated with a deflection plane in one deflection direction and the negative water quantity signal is associated with the deflection plane in a corresponding opposite deflection direction, and the positive temperature signal is associated with the other deflection plane in one deflection direction and the negative temperature signal is associated with said other deflection plane in the correspondingly further opposite deflection direction.

92. The sanitary fitting as claimed in claim 87, wherein:

a first valve of the valve device is a first proportional valve that is connected to the cold water connection on an intake side of the first valve and to the mixed water outlet on an outflow side of the first valve, a second valve of the valve device is a second proportional valve that is connected to the hot water connection on an intake side of the second valve and to the mixed water outlet on an outflow side of the second valve, and the controller actuates the first proportional valve with a first electrical control signal, and actuates the second proportional valve with a second electrical control signal.

93. The sanitary fitting as claimed in claim 87, wherein a light source emits light in different colors as a function of a selected mixed water temperature.

94. The sanitary fitting as claimed in claim 93, wherein the light source is mounted on the control signal transmitter or on the water discharge pipe and is a light-emitting diode (LED).

95. The sanitary fitting as claimed in claim 87, wherein at the end of the continuous reduction in the mixed water temperature value, the current mixed water temperature value is stored in the temperature memory for a defined time.

96. A sanitary fitting, comprising:

a cold water connection;

a hot water connection;

a mixed water outlet;

a valve device for setting a mixed water temperature and a mixed water throughflow rate, wherein the valve device is connected to the cold water connection and the hot water connection at one end and is connected to the mixed water outlet at the other end;

an electrical controller for actuating a valve; and a control signal transmitter for generating an input signal to the controller, wherein:

the valve is an integral constituent part of the valve device, and the controller actuates the valve device as a function of the input signal of the control signal transmitter such that a mixed water temperature and a mixed water throughflow rate are set, the input signal includes a positive water quantity signal, a negative water quantity signal, a positive temperature signal or a negative temperature signal as a function of an operation of the control signal transmitter, the controller transmits a signal for increasing the mixed water throughflow rate to the valve device based on a reception of the positive water quantity signal, transmits a signal for reducing the mixed water throughflow rate to the valve device based on a reception of the negative water quantity signal, transmits a signal for increasing the mixed water temperature to the valve device based on a reception of the positive temperature signal, and transmits a signal for reducing the mixed water temperature to the valve device based on a reception of the negative temperature signal, the controller contains a temperature memory for storing a mixed water temperature value that can be set by the control signal transmitter, a mixed water throughflow memory for storing a current mixed water throughflow rate, and a timer, the controller compares the signal time duration of the negative temperature signal with a negative temperature time value stored in the timer when said negative temperature signal is received, and if the signal time duration is shorter than or equal to the stored negative temperature time value and the current mixed water throughflow rate in line with the value stored in the mixed water throughflow memory is zero, the controller sets the mixed water temperature value in the temperature memory to a lower temperature limit value.

97. The sanitary fitting as claimed in claim 96, wherein:

the control signal transmitter includes a joystick with an operating lever that is mounted on a base element and can be deflected out of a neutral inoperative position in two planes, which are at least approximately at right angles to one another, using an operating lever end region, and the base element is equipped with at least one sensor in order to determine the position of the operating lever relative to the neutral inoperative position and to convert the relative position into the input signal.

98. The sanitary fitting as claimed in claim 97, wherein the operating lever is equipped with a permanent magnet at an end of the operating lever, said permanent magnet interacting with Hall sensors of the sensor, which are firmly mounted with respect to the base element of the joystick.

99. The sanitary fitting as claimed in claim 97, wherein the sensor interacts with a sensor end, which is averted from the operating lever end region, of the operating lever.

100. The sanitary fitting as claimed in claim 97, wherein:

a positive water quantity signal is associated with a deflection plane in one deflection direction and the negative water quantity signal is associated with the deflection plane in a corresponding opposite deflection direction, and the positive temperature signal is associated with the other deflection plane in one deflection direction and the negative temperature signal is associated with said other deflection plane in the correspondingly further opposite deflection direction.

101. The sanitary fitting as claimed in claim 96, wherein:

a first valve of the valve device is a first proportional valve that is connected to the cold water connection on an intake side of the first valve and to the mixed water outlet on an outflow side of the first valve, a second valve of the valve device is a second proportional valve that is connected to the hot water connection on an intake side of the second valve and to the mixed water outlet on an outflow side of the second valve, and the controller actuates the first proportional valve with a first electrical control signal, and actuates the second proportional valve with a second electrical control signal.

102. The sanitary fitting as claimed in claim 96, wherein a light source emits light in different colors as a function of a selected mixed water temperature.

103. The sanitary fitting as claimed in claim 102, wherein the light source is mounted on the control signal transmitter or on the water discharge pipe and is a light-emitting diode (LED).

104. The sanitary fitting as claimed in claim 96, wherein the controller stores said mixed water temperature value.

105. A sanitary fitting, comprising:

a cold water connection;

a hot water connection;

a mixed water outlet;

a valve device for setting a mixed water temperature and a mixed water throughflow rate, wherein the valve device is connected to the cold water connection and the hot water connection at one end and is connected to the mixed water outlet at the other end;

an electrical controller for actuating a valve; and a control signal transmitter for generating an input signal to the controller, wherein:

the valve is an integral constituent part of the valve device, and the controller actuates the valve device as a function of the input signal of the control signal transmitter such that a mixed water temperature and a mixed water throughflow rate are set, the input signal includes a positive water quantity signal, a negative water quantity signal, a positive temperature signal or a negative temperature signal as a function of an operation of the control signal transmitter, the controller transmits a signal for increasing the mixed water throughflow rate to the valve device based on a reception of the positive water quantity signal, transmits a signal for reducing the mixed water throughflow rate to the valve device based on a reception of the negative water quantity signal, transmits a signal for increasing the mixed water temperature to the valve device based on a reception of the positive temperature signal, and transmits a signal for reducing the mixed water temperature to the valve device based on a reception of the negative temperature signal, the controller contains a temperature memory for storing a mixed water temperature value that can be set by the control signal transmitter, a mixed water throughflow memory for storing a current mixed water throughflow rate, and a timer, the controller compares the signal time duration of the negative temperature signal with a negative temperature time value stored in the timer when said negative temperature signal is received, and if the signal time duration is shorter than or equal to the stored negative temperature time value and the current mixed water throughflow rate in line with the value stored in the mixed water throughflow memory is greater than zero, the controller sets the mixed water temperature value in the temperature memory to a lower temperature limit value and, at the same time, actuates the valve unit such that the mixed water temperature is adapted in accordance with the mixed water temperature value with an at least approximately constant mixed water throughflow rate.

106. The sanitary fitting as claimed in claim 105, wherein:

the control signal transmitter includes a joystick with an operating lever that is mounted on a base element and can be deflected out of a neutral inoperative position in two planes, which are at least approximately at right angles to one another, using an operating lever end region, and the base element is equipped with at least one sensor in order to determine the position of the operating lever relative to the neutral inoperative position and to convert the relative position into the input signal.

107. The sanitary fitting as claimed in claim 106, wherein the operating lever is equipped with a permanent magnet at an end of the operating lever, said permanent magnet interacting with Hall sensors of the sensor, which are firmly mounted with respect to the base element of the joystick.

108. The sanitary fitting as claimed in claim 106, wherein the sensor interacts with a sensor end, which is averted from the operating lever end region, of the operating lever.

109. The sanitary fitting as claimed in claim 106, wherein:

a positive water quantity signal is associated with a deflection plane in one deflection direction and the negative water quantity signal is associated with the deflection plane in a corresponding opposite deflection direction, and the positive temperature signal is associated with the other deflection plane in one deflection direction and the negative temperature signal is associated with said other deflection plane in the correspondingly further opposite deflection direction.

110. The sanitary fitting as claimed in claim 105, wherein:

a first valve of the valve device is a first proportional valve that is connected to the cold water connection on an intake side of the first valve and to the mixed water outlet on an outflow side of the first valve, a second valve of the valve device is a second proportional valve that is connected to the hot water connection on an intake side of the second valve and to the mixed water outlet on an outflow side of the second valve, and the controller actuates the first proportional valve with a first electrical control signal, and actuates the second proportional valve with a second electrical control signal.

111. The sanitary fitting as claimed in claim 105, wherein a light source emits light in different colors as a function of a selected mixed water temperature.

112. The sanitary fitting as claimed in claim 111, wherein the light source is mounted on the control signal transmitter or on the water discharge pipe and is a light-emitting diode (LED).

* * * * *